US005626183A

United States Patent [19]

Romanowski et al.

[11] Patent Number: 5,626,183

[45] **Date of Patent: *May 6, 1997**

[54] SYSTEM FOR A CROWN CONTROL ROLL CASTING MACHINE

[75] Inventors: Christopher A. Romanowski, Lake Arrowhead, Calif.; Bruno Amateis, Turin, Italy

[73] Assignee: FATA Hunter, Inc., Riverside, Calif.

[ * ] Notice: The term of this patent shall not extend beyond the expiration date of Pat. No. 5,228,497.

[21] Appl. No.: 95,761

[22] Filed: Jul. 20, 1993

Related U.S. Application Data

[63] Continuation-in-part of Ser. No. 670,497, Jun. 6, 1991, Pat. No. 5,228,497, which is a continuation of Ser. No. 379,884, Jul. 14, 1989, abandoned.

[51] Int. Cl.[6] ..... B22D 11/06; B22D 11/124

[52] U.S. Cl. ..... 164/428; 164/480; 164/448; 164/443; 164/442

[58] Field of Search ..... 164/428, 480, 164/448, 442, 443, 485, 479, 429

[56] References Cited

U.S. PATENT DOCUMENTS 5,228,497 7/1993 Romanowski ..... 164/428

FOREIGN PATENT DOCUMENTS 61-189854 8/1986 Japan ..... 164/442

5-115951 5/1993 Japan ..... 164/448

*Primary Examiner*—Jeanne M. Elpel
*Assistant Examiner*—I.-H. Lin
*Attorney, Agent, or Firm*—Knobbe, Martens, Olson & Bear

[57] ABSTRACT

The local thickness across the width of a cast sheet is regulated by controlling the crown of the work rolls in a twin roll continuous casting machine producing the sheet. The work roll crowns are controlled by providing differential cooling in a plurality of cooling subsystems along the length of the rolls. The work rolls contain inlet and outlet water plenums which are connected to peripheral cooling channels between a core and an outer shell of each roll. Water flow to the cooling subsystems is controlled by a movable sleeve within the outlet plenum. In a first position of the sleeve, water is permitted to flow through all areas of the work rolls providing an even heat removal. In a second position, a greater portion of water flows through cooling subsystems in the center portion of the work rolls resulting in increased removal of heat from the center area of the core, reducing the temperature in this area, and thus reducing the crown of the work roll. The sleeve in each roll may be moved incrementally between the first and second positions to provide incremental control over the size of the work roll crowns and the resulting crown of the sheet produced by the rolls. A water manager diverts inlet water to the off-center inlet plenums in the core while removing discharge water from the central outlet plenum. The water manager provides a fluid-tight bearing for a linear actuator acting on the sleeve.

57 Claims, 12 Drawing Sheets

SYSTEM FOR A CROWN CONTROL ROLL CASTING MACHINE

CROSS-REFERENCE TO RELATED APPLICATION

This application is a continuation-in-part application of U.S. application Ser. No. 07/670,497, filed Jun. 6, 1991, which issued on Jul. 20, 1993, as U.S. Pat. No. 5,228,497, which is a continuation of application of U.S. application Ser. No. 07/379,884, filed Jul. 14, 1989, and now abandoned, in the name of Romanowski, and which is entitled "Roll Casting Machine Crown Control".

FIELD OF THE INVENTION

The present invention relates generally to a machine for the continuous roll casting of metal into a thin strip or metal sheet directly from molten metal, and in particular to the control of the crown of the sheet by controlling the crown of the work rolls in such a machine.

BACKGROUND OF THE INVENTION

Twin roll continuous casting of aluminum was developed into a commercial process in the early 1950s. Since then, the process has gained worldwide acceptance in the aluminum industry as an economical method for producing a wide variety of flat-rolled products. The twin roll casting process converts molten aluminum directly into thin cast strip suitable for cold rolling; thus effectively eliminating the ingot casting, sawing, scalping, reheating and hot rolling associated with the traditional die-cast ingot and hot mill method of production. This significantly reduces the capital investment required and also produces considerable savings in energy, consumables and manpower. These economic benefits give twin roll caster based plants a pricing advantage in the increasingly competitive world aluminum market.

In twin roll continuous casting, molten aluminum of a constant composition, temperature and level is degassed and filtered before being introduced into the "head box" of the casting machine. The head box is connected to an elongate planar pouring nozzle commonly known as the "tip" which distributes the metal between the twin rolls of the machine, the width of the nozzle determining the width of the cast strip. The exit of the planar nozzle is slightly upstream of the centerline of the twin rolls, thus the work rolls of the caster solidify and hot roll the aluminum in one process. This combination of solidification and hot rolling generates a substantial roll "separating force." In other words, this separating force tends to force the two work rolls apart, in opposite directions through the roll axes. For example, a typical 1700 mm wide, 1000 mm roll diameter foil stock caster may experience separating forces in excess of 2000 metric tons.

In order to withstand and offset such great separating forces, which typically are uniformly distributed over the width of the rolls, the rolls are constructed of extremely rigid metal alloys in a barrel-shaped configuration so that their middle portion, which experiences the greatest deflection, may deflect to a greater extent than their outer edge portions to result in a nominally flat roll surface. The rolls commonly have a relatively thick outer "shell" for contacting the molten aluminum which is fabricated from a hard alloy steel, such as a chrome nickel alloy steel. The extreme heat of the molten metal and large mass of such rolls, including their outer shells, requires internal cooling to withdraw heat at a sufficient rate, and to prolong their life.

Because of the variations in the casting environment, such as the composition of the alloys being cast, the thickness being cast, the speed at which the rolls are turned, the width of the particular sheet, the rate of cooling/solidification, and other factors, it is impossible to design a particular construction of the rolls or their shells to deflect in a way to produce the desired sheet flatness in all cases. Aluminum sheet is preferably roll cast slightly thicker in its center to allow the sheet to be self-centering during subsequent operations in a rolling mill. Specifically, it is generally desirable to have an approximately 0.5–1.5% greater thickness in the center of the sheet as compared to the edge thicknesses. This increased center thickness is referred to as the "crown" of the sheet. If this center portion is thinner than the edges, it is sometimes referred to as "negative crown." At present, there is a need for a fine control of the output thickness of the cast aluminum sheet when the above-mentioned factors are constantly being varied.

Controlling the temperature of work rolls is desirable for maintaining a preferred distance or "gap" between rolls during the roll casting operation. If the temperature of a work roll is permitted to increase, its circumference will increase due to its thermal expansion, reducing the thickness of the sheet being roll cast.

Besides controlling the overall temperature of work rolls, it is also desirable to control the temperature at various locations along the length of a roll. The center of a work roll tends to heat up and expand more than its ends, resulting in the formation of a thermally induced crown on the roll. This roll crown, which may be referred to as a "positive" crown, then results in a central indentation or "negative crown" on the sheet or strip being cast. As little as a ten-degree Fahrenheit differential between the center and the ends of a roll may cause a crown to develop.

A limited amount of positive roll crowning is desirable to offset the bending of the work rolls by the sheet being cast. However, excessive roll crowning will cause the sheet to be roll cast thinner in its center portion than at its edges, resulting in a negative sheet crown. This is undesirable when the sheet is to be cast flat, for example, when foil will be made from the sheet. Current internal work roll cooling systems are not able to provide greater cooling to the center of the roll than to its ends to control excessive crowning. In other words, the relationship between the amount of cooling water circulating in the center of the roll and the ends is typically fixed. Due to variable cooling conditions caused by the roll casting of different metals at different thicknesses, and other factors, excessive work roll crowning may still occur even with these internal cooling systems.

In U.S. Pat. No. 4,565,240 to Shibuya, et al., a continuous twin roll caster is shown which utilizes variable pressure underneath the midportion of the outer shell of the roll to elastically deform the outer shell to control the amount of crowning in the middle. Initially, the outer shell has a negative crown and the pressure to the underside of the center portion is at a maximum to produce a flat roll. As molten metal is introduced between the rolls, the outer shell attains a positive crown and thus the pressure is decreased accordingly to maintain the flat profile of the roll. This type of crown control for the rolls can only be accomplished with relatively thin outer shells or sleeves which are readily deformable upon application of hydraulic pressure. Furthermore, in Shibuya, et al., the amount of control of the crown is a relatively coarse adjustment with only a single pressure chamber in the middle.

In U.S. Pat. No. 4,721,154, issued to Christ, et al., a continuous casting machine for rapidly solidifying metal is shown. Molten metal is fed through a planar nozzle onto a traveling cooling surface for rapidly solidifying the metal. To produce a foil having variable local thicknesses, the spacing between the nozzle and the flexible cooling surface of the roll is varied. This is accomplished by applying variable pressures under the cooling surface of the shell to meter an outflowing mass of molten metal from the nozzle. Again, such control of the thickness of the finished foil can only be accomplished using a relatively flexible shell. In this case, the shell is made from a copper or copper alloy having a thickness in the range of a few millimeters.

Lastly, U.S. Pat. No. 3,757,847 to Sofinsky, et al., describes a roll cooling system including a central header. The header controls the distribution of the cooling water into the roll. However, the header of this device acts to position the cooling water flow into and out of circumferential sections of radial passageways in the roll, and not laterally along the roll. Therefore, the header of Sofinsky, et al. acts to direct inlet cooling water to one section of the roll, and to direct outlet water through the other sections, while along the length of the roll in a given section, the flow is the same. Thus, this cooling system cannot achieve roll crown control. Furthermore, the cooling system of Sofinsky, et al., effectively, only cools one-third of the width of roll.

The patents to Christ, et al.; Shibuya, et al.; and Sofinsky, et al. are classed as roll mold casters which do not apply any pressure to the molten material in order to hot roll it. These roll mold casters are used when it is not required or desirable to achieve a finer microstructure in the cast strip, which can only be achieved by high pressure applied by the work rolls. The absence of feedback force on the rolls in roll mold casting devices allows the use of very thin, flexible shells or other cooling surfaces which can be elastically deformed using sub-surface fluid pressure. Such cooling systems control devices are unsuitable for very heavy, continuous roll casters having extremely thick and rigid shells which experience thousands of tons of separating force.

Additional disadvantages and distinctions over the present invention of previous continuous casting and molding machines could also be articulated. Thus, the foregoing should not be considered exhaustive in this regard.

Therefore, there exists a substantial need for an improved system to better control the crown of work rolls in roll casting machines, and thereby control the crown of sheet produced by such machines.

SUMMARY OF THE INVENTION

The present invention comprises a roll casting machine having a frame supporting a pair of internally water cooled work rolls mounted in the frame for rotation about parallel axes. Molten metal to be cast is introduced into the bite between the work rolls. A mechanism is provided for controlling the cooling capacity of the water in at least a portion of one of the work rolls for providing a controlled temperature differential between the middle of the roll and the ends of the roll.

In an exemplary embodiment of the invention, each work roll comprises a core and a shell secured on the core. The core also has at least one axially extending cooling water inlet plenum, at least one axially extending outlet or discharge plenum, and a plurality of cooling water channels formed in the perimeter of the core. The core also has a plurality of radially extending cooling water passages extending between the plenums and the channels. A sleeve in the discharge outlet plenum has a plurality of openings located to communicate with the radially extending passages. The sleeve is movable between at least a first position with the openings in relatively greater alignment with at least a portion of the radially extending passages, and a second position with the openings in a relatively lesser alignment with such radially extending passages.

However, the sleeve can be moved both axially and circumferentially to vary the amount of water delivered to a particular location along the length of the roll.

For example, in one position, an even flow of water may be delivered to all portions of the roll. In the other position, relatively more or less water may be directed to a portion of the roll, such as its center, to reduce or increase the amount of crowning of the work roll. The flow of water between the first position and the second position may be incrementally changed to provide a greater control over the work roll crown. Control of the work roll crown permits the desired control of the crown of the sheet being cast.

In a preferred form of the roll casting machine, the core includes at least one axially extending inlet plenum and the aforementioned discharge outlet plenum having a movable sleeve. The inlet plenum receives cooling water and distributes the cooling water to the exterior of the core underneath the outer shell through one or more generally radially extending inlet passages. The cooling water circulates around the periphery of the core through the cooling water channels and enters the aforementioned cooling water passages which communicate with the outlet plenum having the sleeve. The cooling water passages and outlet plenum comprise a system for removing hot discharge water from the perimeter channels. Thus, the movable sleeve serves to meter the amount of outlet cooling water flowing through various portions of the work roll. This metering of the output, rather than input, water flow creates a higher back pressure in the cooling water flow when the output flow is decreased. The increased back pressure serves to reduce the creation of bubbles from vaporization of the cooling medium, commonly water.

In a further aspect of the present invention, there are three inlet water plenums extending axially through the work rolls and a single outlet plenum extending along the axis of the work roll. The inlet plenums are arranged at a common radial distance from the axis of the work roll and are spaced apart 120°. Each of the inlet plenums communicates through a plurality of inlet passages spaced along the width of the core. The passages end at points around the periphery of the core, the points being also spaced 120° apart. These points define inlet nozzles at the core to provide inlet water to the cooling channels formed around the periphery of the core. The outlet plenum communicates with three outlet passages formed at each of a number of locations spaced axially along the width of the core. The outlet passages are 120° apart around the periphery of the core at each location. Each outlet passage begins at the core periphery at an outlet passage opening which is disposed midway between two of the water inlet nozzles. Thus, the inlet water flows through the inlet plenums and through the inlet passages to the outlet nozzles which are spaced 60° from the surrounding outlet passage openings on the periphery of the core. The water flows in both directions out of the nozzles with maximum travel of 60°. This short distance of cooling water travel reduces the temperature differentials of the cooling water around the periphery of the core, resulting in a more uniform core temperature or, if desired, a core in which temperature differentials can be intentionally achieved and carefully controlled.

In addition, each of the inlet passages and corresponding inlet nozzles is offset with respect to an adjacent axially spaced inlet passage and nozzle. To be more precise, each inlet water passage is associated with two other inlet water passages at the same axial location on the work roll. Three outlet water passages are also formed in the same plane at the same axial location as the three inlet passages. In one embodiment, each of the three inlet passages supply water to two adjacent peripheral channels. In order to prevent the introduction of cooling water at the same 120° circumferentially spaced points along the axial length of the work roll, the three inlet nozzles are rotated 60° in adjacent pairs of peripheral channels. Hence, in combination with the reduced travel of the cooling water around the periphery, the offset positioning of the inlet passages achieves a nearly isothermal roll pattern, assuming equal flow of water through all the passages.

In one important aspect of the present invention, the roll casting machine incorporates an extremely effective and accurate mechanism for controlling the flow of water to various points along the axial length of the work roll. This mechanism utilizes only one moving part, other than the rotating work rolls, and thus is extremely simple and reliable to operate. The sleeve preferably rotates with the work roll and is displaced axially in real time by a highly accurate linear actuator operating in a feedback loop, thus simplifying the control steps required during operation. In the preferred embodiment, the roll casting machine utilizes a preferred configuration of the movable sleeve to produce a best estimate for the resulting thickness of the cast sheet. This is a type of "coarse" adjustment for sheet thickness. This adjustment can be achieved in one embodiment by rotating the sleeve in a circumferential direction relative to the core. Another type of coarse adjustment can include the use of a shell with a different cross-sectional shape, be it barrel shaped, etc. During operation, as the molten metal continues to heat up the work rolls and as conditions change, the axially movable sleeve can be adjusted to compensate dynamically based on information delivered from various sensors, which detect the thickness of the cast sheet downstream. Thus, the movable sleeve serves as a "fine" or more accurate control of the sheet thickness.

The present invention incorporates a highly effective and reliable system for delivering water to the inlet plenums and withdrawing water from the central outlet plenum, while providing a mechanism for coupling the linear actuator to the central movable sleeve. This mechanism ensures the precise axial alignment of the sleeve within the work roll. A rotating water joint generally comprises the inner movable sleeve surrounded at one end by a rotating partition, which is rigidly fixed in alignment with the work roll, and an outer absolutely fixed water jacket. The outer jacket includes inlet and outlet ports for cooling water, the inlet and outlet water ports being in communication with the appropriate inlet or outlet plenums within the work roll.

Specifically, the rotating partition, having a generally cylindrical configuration, extends concentrically within the fixed outer jacket to rotate therein in a fluid tight relationship. The rotating partition provides for the separation of inlet and outlet water. The inner sleeve is held within bushings mounted to the partition in order to rotate therewith yet be free to slide axially relative thereto. The sleeve includes apertures in communication with a first annular region within the partition, which in turn communicates with a first annular space within the external water jacket, this space being connected to the outlet port. A sealed annular divider separates the first annular region with a second annular region between the sleeve and the partition wall, the wall having apertures in communication with a second annular space within the jacket which has the inlet port connected thereto. The second annular region between the sleeve and the partition is in fluid communication with the three inlet plenums of the work roll so that water entering through the inlet port may travel around the second annular region and into the inlet plenums, thereafter to be utilized for cooling the work roll and then to flow into the central sleeve. The used water then flows axially through the sleeve and out the apertures in the sleeve into the first annular region and the first annular space to exit through the outlet port.

The terminal end of the central sleeve has a plug with an extending shaft stub. The shaft stub is journaled within a large thrust bearing for a relatively frictionless rotation therein. The linear actuator is coupled to a portion of a two piece member clamped over the outer race of the thrust bearing so that displacement of a linear actuator shaft causes a force to be applied through the thrust bearings and to the shaft stub of the plug, thereafter to be transmitted to the axial sleeve for producing the desired axial displacement.

In a further aspect of the present invention, the central axially movable sleeve may be rotated between casting operations relative to the work roll. This adjustment allows the user to use a different set of openings in the sleeve to achieve a rippled sheet effect or other unusual sheet configuration, or to provide a "coarse" adjustment for crown control, or to otherwise vary the degree of crown control. The sleeve is fixed to a bracket which may slide longitudinally over a pin mounted in the rotating partition to orient the sleeve rotationally with respect to the partition, and thus the core as well. The bracket may be adjusted to one or more orientations on the sleeve. Such adjustment is advantageous in that a different set of openings in the sleeve can be aligned with the radially inner ends of the water outlet passages.

The ability to change the arrangement of the aligned sleeve openings, both axially and circumferentially, provides great flexibility in controlling the profile of the cooling water along the width of the work rolls. For example, the ratios between flow rates along the work roll due to changes in the axial position of the sleeve can be customized to the specific parameters of changing casting operations. While one operation may require the ability to produce a negative crown on the work roll (in order to achieve a positive crown on the sheet), other operations may require the formation of a non-symmetric crown or other exotic crown profile.

The precision axial or linear movement of the sleeve is important in order to provide a fine, extremely accurate control system for roll crowning. Thus, the movement of the sleeve relative to the central plenum, while both are rotating and moving relative to one another, must be controlled. The present roll casting machine ensures the precise alignment of the central axial sleeve in order to substantially eliminate the resistance to sleeve axial movement and also prevent the occurrence of runout of the large rotating partition. In a preferred embodiment, the alignment takes the form of a precision machined adaptor plate adapted to be firmly affixed to the terminal end of the work roll in a known concentric position. The rotating partition is then bolted firmly to the adaptor plate to ensure its concentric rotation as well. A plurality of precision machined brass bushings retain the axial sleeve within the rotating partition in a known concentric orientation with respect to the adaptor plate. The thrust bearings also assist in maintaining axial alignment of the sleeve and smooth, low malfunction operation.

These and other advantageous features of the present roll casting machine will become apparent in the following detailed description.

BRIEF DESCRIPTION OF THE DRAWINGS

The above-mentioned and other features of this invention are more fully set forth in the following description of the presently preferred embodiments, which description is presented with reference to the accompanying drawings, wherein.

DESCRIPTION OF THE PREFERRED EMBODIMENTS

Figure 1:
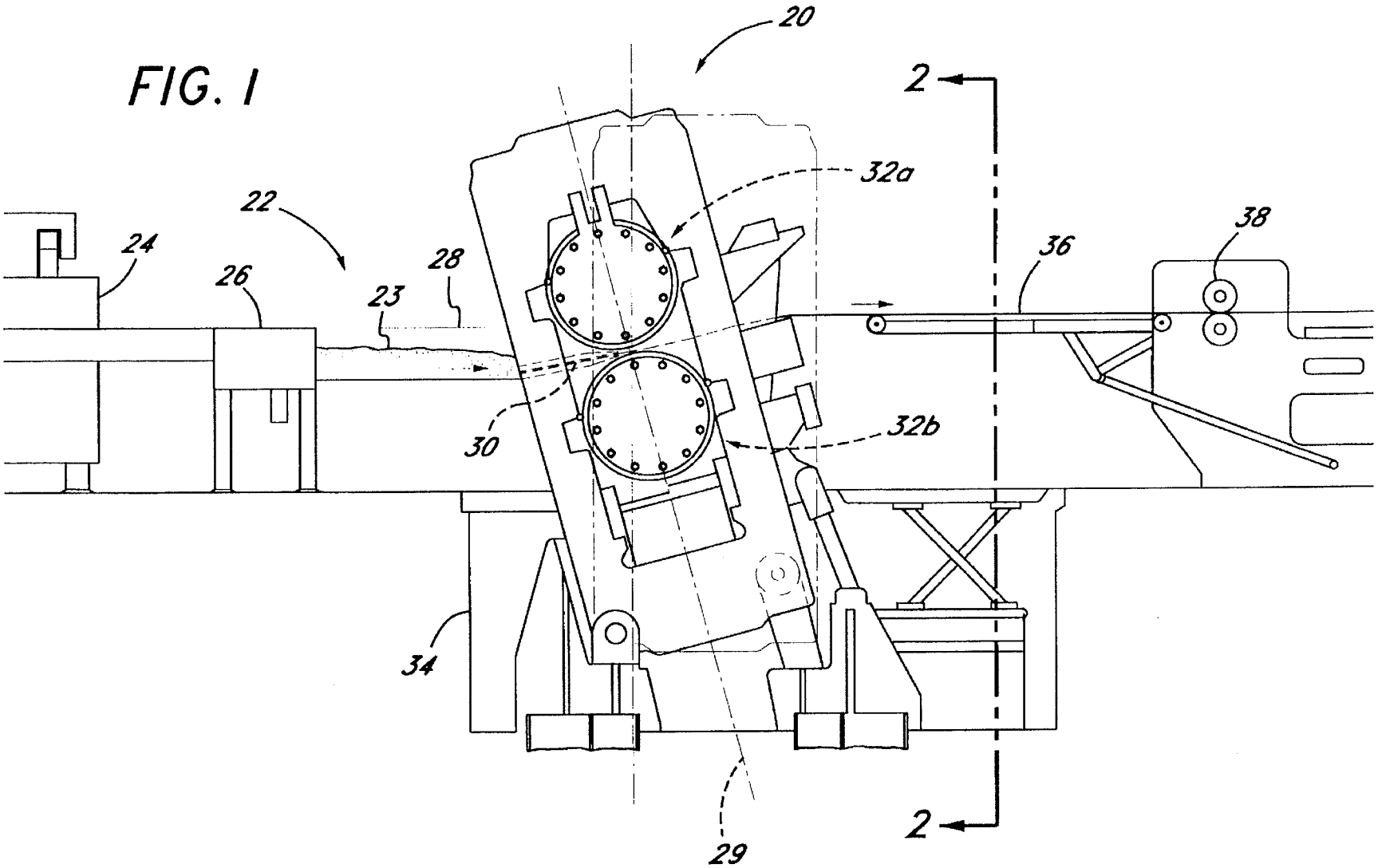
FIG. 1 is a schematic side elevational view of a twin roll continuous casting machine of the present invention.

FIG. 1 shows a continuous twin roll casting machine 20 in a casting process line 22. Molten aluminum 23, preferably of a constant composition, temperature and level, is degassed in unit 24, then passed through a filter 26 prior to entering a head box 28. A planar pouring nozzle or tip 30 which distributes the metal between twin work rolls 32*a,b* (FIG. 2) is connected to the head box 28. The width of the tip 30 determines the width of a strip 36 which is cast.

The rolls 32*a,b* are supported at their ends within a frame 34. The central axes 31*a,b* of the work rolls 32*a,b* are aligned at a 15-degree tilt from vertical, which allows regulation of the molten metal 23 tip exit pressure by control of the head box 28 level. This permits smooth flow of the molten metal 23 from the tip 30 to a bite 35 between the work rolls 32*a,b*. The spacing between the work rolls 32*a,b* is held constant by a hydraulic system (not shown).

During operation of the casting machine 20, the upper work roll 32*a* is rotated counterclockwise, while the lower work roll 32*b* is rotated clockwise, as molten metal is fed from the tip 30 into the bite 35 between the rolls. Heat is absorbed by the rolls 32*a,b* crystallizing the metal which emerges from the rolls in the form of the hot rolled strip 36. On exiting the casting machine 20, the strip 36 passes through a set of pinch rolls 38 and a traveling shear (not shown) before being wound into a coil.

Figure 2:
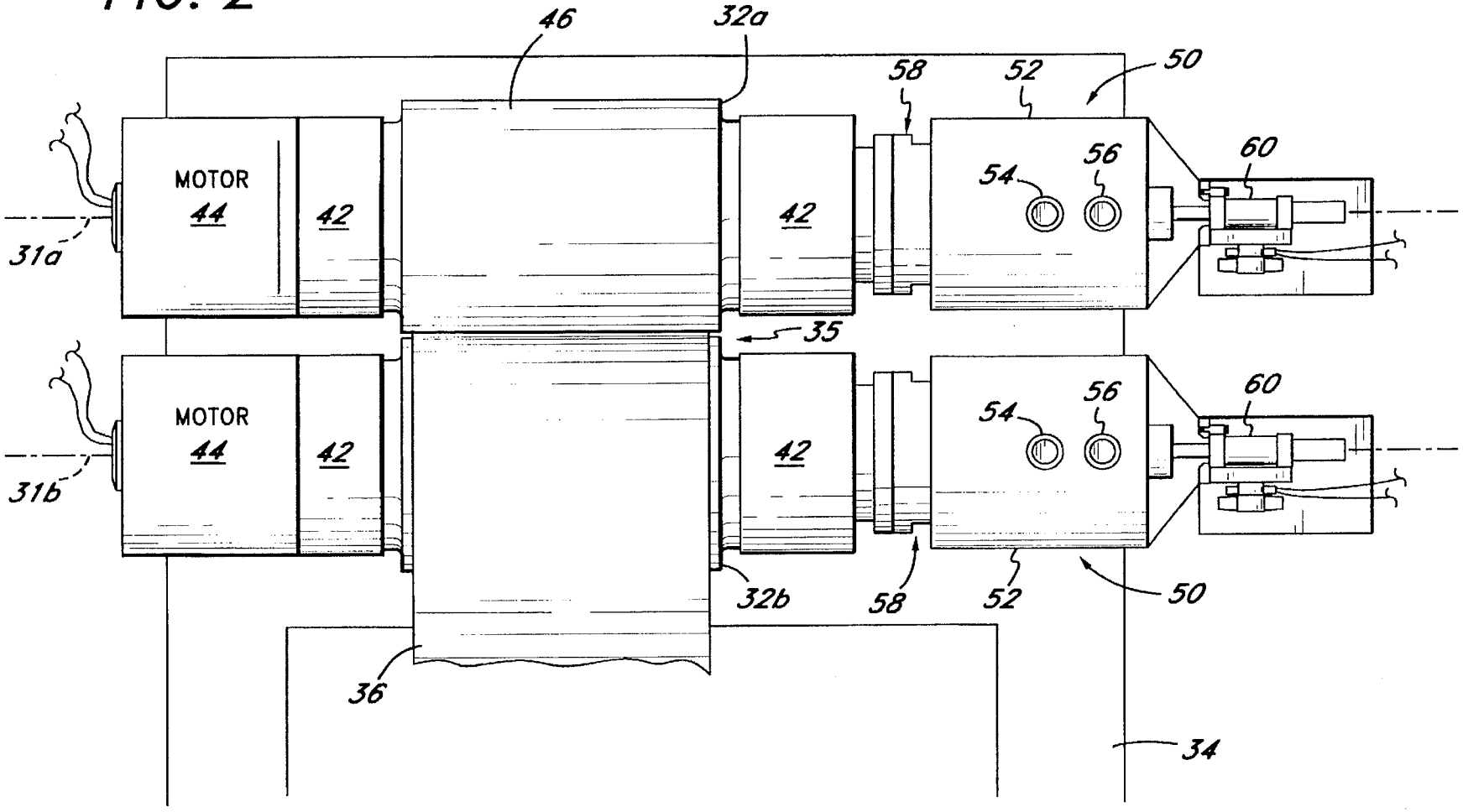
FIG. 2 is a front elevational view of the twin roll continuous casting machine of FIG. 1.

Now, with reference to FIG. 2, the work rolls 32 are shown supported by large bearings 42 which are mounted in the frame 34. The rolls 32*a,b* are independently driven by separate DC motors 44 and epicyclic gear reducers (not shown). The motors 44 are synchronized by a sophisticated digital control system which monitors and regulates many of the critical parameters in the casting process. The outer surface of the work rolls 32*a,b* includes a steel shell 46 which is shrunk fit onto an inner core 48 (shown in FIG. 3). The outer surfaces of the caster roll shells 46 are continuously sprayed with a water-base suspension of graphite or boron nitride to act as a lubricant and parting agent so that the strip 36 does not pit, gall or stick to the shell.

As stated above, the exit of the tip 30 is slightly ahead or upstream of the centerline 29 of the work rolls 32, and thus the rolls solidify and hot roll the aluminum in one step. The distance from the exit of the tip 30 to the centerline 29 of the rolls is referred to as the "setback." The combination of solidification and hot rolling generates a substantial roll separating force which can be in excess of 2,000 metric tons. Thus, the bearings 42 and frame 34 must be of a sufficient strength to withstand such separating forces. The simultaneous solidification and hot rolling that occurs in the twin roll casting process produces a characteristic micro structure which is considerably different to that obtained from conventional DC ingot and hot mill methods. These differences are based on the rapid solidification rate of the metal and the residual deformation in the cast strip. The rapid solidification rate reduces the size and spacing of any primary constituents in the strip. Compared with conventional methods, such as roll mold casting, there is approximately 80% reduction in the size of intermetallic particles while the hot rolling produces a cast strip having some residual worked structure which is slightly harder than conventional hot mill material.

Cooling System

The present casting machine 20 provides an improved cooling system which may be used to control the crown of the continually cast strip 36 by differential internal cooling of the work rolls 32*a,b*. The system operates by controlling the flow of internal cooling water in a plurality of cooling subsystems along the length of the work rolls 32*a,b*.

As illustrated in FIG. 2, a water flow control manager 50 extends from the right end of each of the work rolls 32*a,b*. The manager 50, which will be described in more detail below with reference to FIG. 12, generally includes an inlet pipe 54 and an outlet pipe 56 connected to a fixed outer jacket 52. A rotating portion or partition of the manager 50, generally shown at 58, is concentrically journaled within the jacket 52 using a fluid-tight rotating seal, and is firmly attached to the work roll 32. Inlet water entering through the inlet pipe 54 passes into the rotating partition 58 of the manager 50 and is directed through one or more plenums (not shown) which extend the axial length of each of the work rolls 32*a,b*. The water cools the work rolls 32*a,b* and is then directed back through the rotating partition 58 of the manager 50 to the exit pipe 56. In this manner, the work rolls 32*a,b* are sufficiently internally cooled to crystallize the molten metal 23 and reduce damage to the shell 46 from excessive temperature.

Still referring to FIG. 2, a linear actuator 60 is located on the right end of the water flow control manager 50 and is linearly coupled to an internal sleeve 62 (FIGS. 4–11) which is used to control the amount of cooling water passing through different portions of the roll 32*a,b*. A detailed description of how the linear actuation of the sleeve 62 is accomplished is discussed below.

Referring now to FIG. 3 again, a work roll 32 is shown separated from the casting machine 20. The work roll 32 generally comprises an inner steel core 48 on which the aforementioned shell 46 has been placed while thermally expanded. The shell 46 is then cooled to shrink fit the shell onto the core 48.

Figure 3:
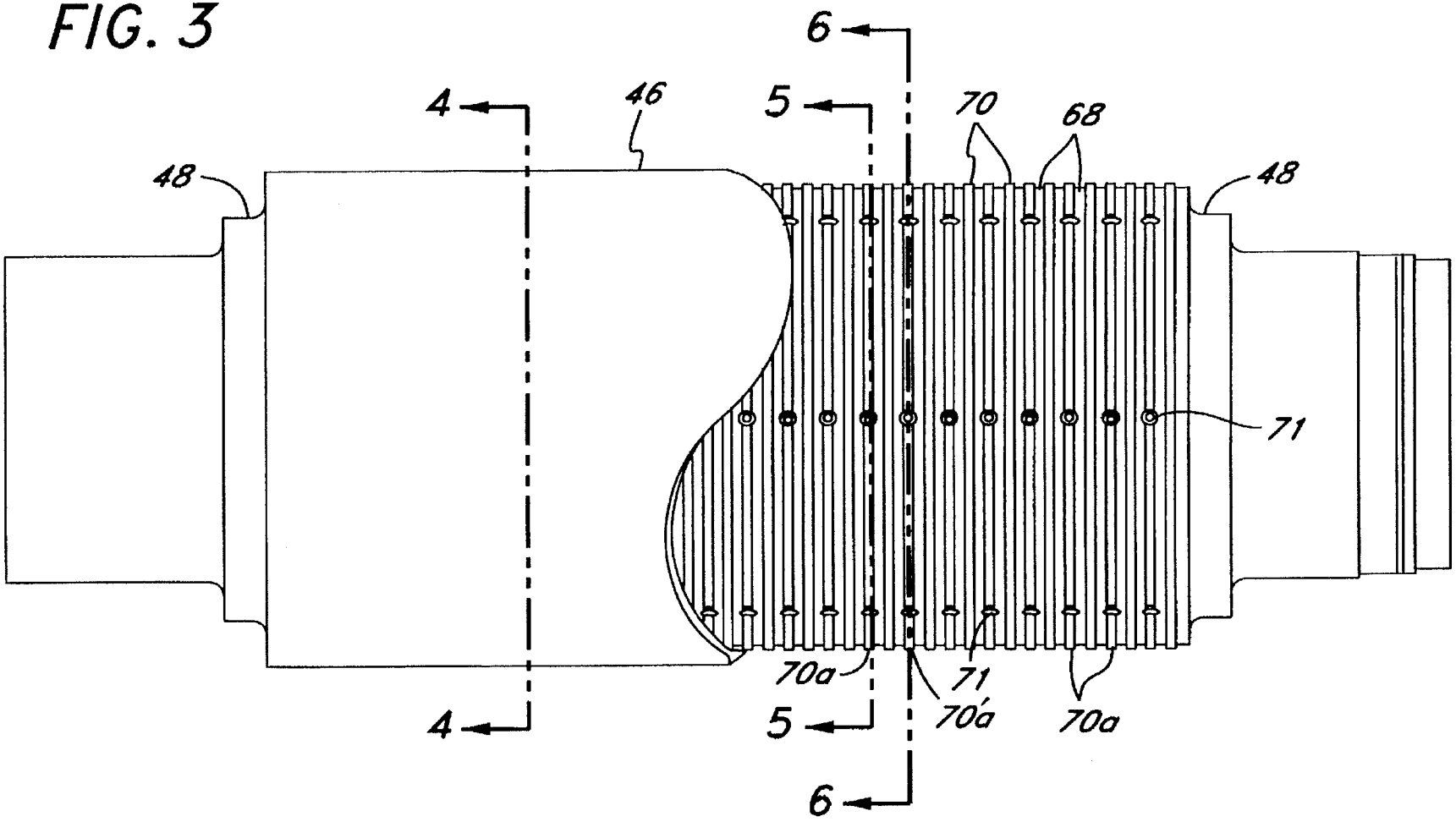
FIG. 3 is a front elevational view of one of the work rolls of the casting machine with an outer shell partially cut away.

In FIG. 3, the shell 46 is shown partially cutaway to expose a plurality of circumferential cooling channels 68 extending substantially the length of the work roll 32. The channels 68 are defined by a series of parallel annular ribs 70 which contact the internal surface of the shell 46. Every other rib 70*a* includes a number of outer mouths 71 of generally radially extending water flow passages bored therein, which passages either supply or remove cooling water from the two channels 68 adjacent the rib. Preferably, there are a number of passages but only one inlet and one outlet are possible. The channels 68 and ribs 70 may be formed in a cylindrical core shell and mounted onto a central shaft.

Figure 6:
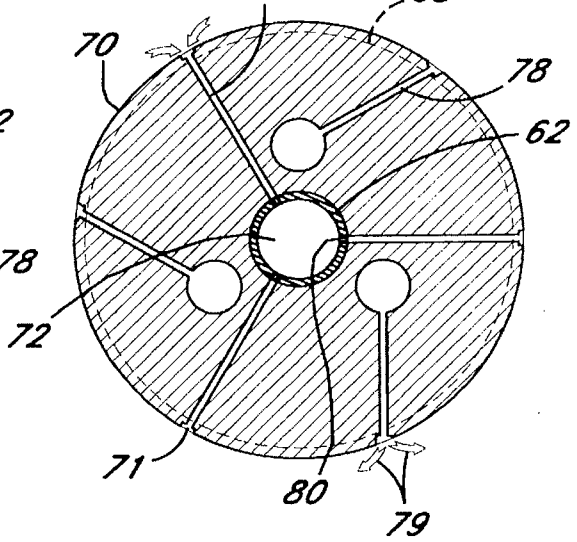
FIG. 6 is a cross-sectional view of the core of the work roll taken along line 6—6 of FIG. 3.
Figure 5:
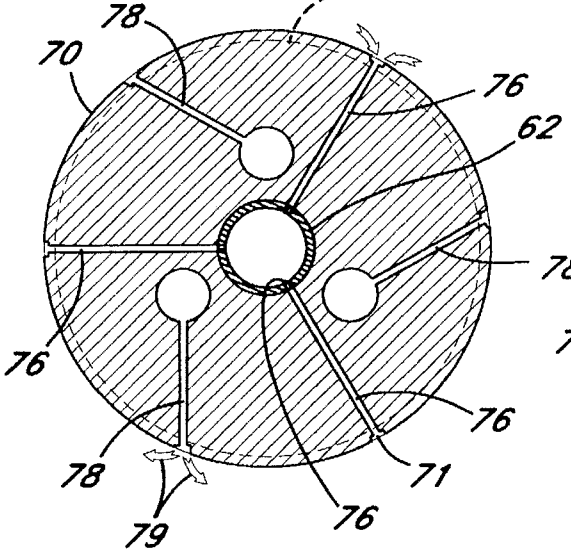
FIG. 5 is a cross-sectional view of a core of the work roll taken along line 5—5 of FIG. 3.
Figure 4:
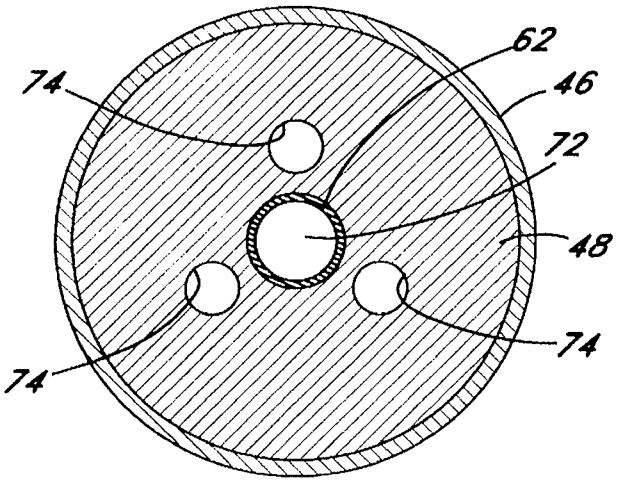
FIG. 4 is a cross-sectional view of a core of the work roll taken along line 4—4 of FIG. 3.

FIGS. 4, 5 and 6 are cross-sectional views taken at corresponding points of the roll 32, as noted in FIG. 3. These figures illustrate a cooling water outlet plenum 72, which is preferably located along the centerline of the roll 32, and three cooling water inlet plenums 74 located within the core 48. The outlet plenum 72 is lined by an internal sleeve 62, noted above. The plenums 72, 74 may be cast directly with the core 48 or may be bored into the core 48. FIG. 4 illustrates a cross section through a rib 70 between the alternating ribs 70*a* in which the cooling water passages terminate, as described above. This figure further illustrates the snug fit of the shell 46 around the ribs 70*a* of the core 48.

FIGS. 5 and 6 are cross sections through two adjacent alternating ribs 70*a*, illustrating a number of outlet passages 76 and a number of inlet passages 78. Preferably, there are three inlet 78 and outlet passages 76 such that the core 48 is divided into six equally sized circumferential regions on the surface. FIGS. 5 and 6 illustrate the manner in which inlet and outlet passages 76, 78, in adjacent annular ribs 70*a*, are offset 60° from one another, as explained in more detail below.

The outlet passages 76 fluidly connect adjacent circumferential channels 68 with the central outlet plenum 72. Each of the inlet passages 78 fluidly connects the same two adjacent circumferential channels 68 with one of the inlet plenums 74 due to their termination in the intermediate rib 70*a*. Inlet cooling water is supplied to the inlet plenums 74 and is delivered to the two adjacent channels 68 through the inlet passages 78. The cooling water flows in each direction, as shown, within the two cooling channels 68 between the core 48 and the shell 46 and enters the core 48 again at the mouth 71 of the next outlet passage 76, which is connected to the centrally located outlet plenum 72. The hot discharge water then moves in the axial direction along the work roll 32 in the outlet plenum 72, eventually reaching the outlet pipe 56 (see FIG. 2).

A cooling subsystem comprises the inlet plenums 74, the three inlet passages 78 in one section of the core 48, the two channels 68 to which the inlet passages communicate, the three outlet passages 76, and the outlet plenum 72. This cooling subsystem provides cooling water to two adjacent channels 68 around the periphery of the core and thus a plurality of such cooling subsystems are needed along the length of the core. The number of subsystems depends upon the number of channels 68 along the length of the roll 32.

The present casting machine 20 incorporates several features to provide improved isothermal cooling. First, cooling water preferably flows a maximum distance of 60° around each circumferential channel 68. Referring to FIGS. 5 and 6 it can be seen that cooling water exiting one of the inlet passages 78 travels in both directions about the core 48, as shown by arrows 79, to meet the next outlet passage mouth 71. As stated above, because the roll 32 is divided into six equal segments, the cooling water thus travels a maximum of 60° in either direction to reach the outlet passage mouth 71. It is noted that as the work roll 32 rotates, the temperature differential on the exterior of the shell 46 between a point adjacent an inlet passage 78 and a point near an outlet passage 76, because of the short distance the cooling water travels, is thus quite small. Therefore, the resulting effect on the cast strip 36 is minimized in part because large temperature differentials around the circumference of the shell 46 cause the shell 46 diameter to vary, thus causing corresponding varying thicknesses of the cast strip 36.

The use of this preferred embodiment arrangement, which allows the cooling water to flow a maximum of 60° around the circumference of the roll 32. Further, although three inlet passages 78 and three outlet passages 76 are shown herein as a preferred embodiment of a cooling subsystem, there may be four or more of such passages arranged to decrease the circumferential distance which the cooling water travels between an inlet and an outlet even further in order to maintain the exterior surface of the work roll at a more constant temperature.

To further prevent unwanted temperature gradients around the circumference of the work roll 32, the passages 76, 78 intersect the circumferential cooling channels 68 at offset points for alternating cooling sub-systems along the axial length of the work roll 32. Specifically, as shown in FIG. 5, which is a cross section through the core 48 at the location of one of the ribs 70*a*, the inlet passages 78 communicate with the circumferential cooling channels 68 at points corresponding to 3:00, 7:00 and 11:00 o'clock. Conversely, the outlet passages 76 intersect the channels 68 at points corresponding to 1:00, 5:00 and 9:00 o'clock. Now looking at FIG. 6, which is a cross section through the core 48 at a rib 70*a'* spaced two ribs from rib 70*a*, the inlet passages 78 are at 1:00, 5:00 and 9:00 o'clock, while the outlet passages 76 are at 3:00, 7:00 and 11:00 o'clock. In this scheme, the three peripheral points at which the inlet passages 78 connect to the cooling channels 68 are rotated 30° from one cooling subsystem to the next, preventing the inlets and outlets from lying in a line along the length of the roll 32.

A second feature for controlling cooling of the roll is through the use of a sleeve. As stated above, water is circulated through the core 48 by a cooling water pump (not shown) attached to the inlet plenums 74 to create positive cooling water pressure and flow within the cooling system. The positive water pressure created thereby reduces the formation of steam bubbles within the system, improving the efficiency of the cooling water.

It is noted that it is possible to alter the cooling capacity at any point along the axial length of the core 48 by increasing or decreasing the size of the inlet or outlet passages within that section of the core and metering the water flow. In the present preferred embodiment, however, water is metered through the outlet passages 76 through the use of a sleeve 62 located in the outlet plenum 72. As best seen in FIG. 7, which shows the terminal end of the sleeve 62 in the outlet plenum 72, the sleeve 62 includes at least three sets of elongated slots 80 which communicate with each outlet passage 76. There are three slots per cooling subsystem corresponding to the three outlet passages 76. Due to the fact that each adjacent outlet passage 76 intersects its respective outlet plenum 72 at a location 60° offset from the adjacent passage, the elongated slots 80 must also be offset 60° around the sleeve from each adjacent slot, which is shown in FIG. 7.

When the elongated slots 80 are lined up with each corresponding outlet passage 76, maximum water flows through the peripheral channels 68. However, the preferred embodiment sleeve 62 may be displaced linearly along the axis of the work roll 32. The outlet passages 76 are preferably obstructed, at least partially, in certain areas of the roll so as to reduce the flow rate of the cooling water. Reducing the cooling water flow by metering the amount of outflow creates a preferred positive back pressure, improving the efficiency of the cooling system. In this manner, the pump supplying the cooling water is run at a preferred optimum speed to maintain a sufficient supply of cooling water to all the cooling channels 68 around the core 48 when the slots 80 are fully aligned with the outlet passages 76. Then, when the slots 80 are moved so as to decrease the amount of flow through the outlet passages 76, the pump works against an elevated back pressure.

As noted above, the sleeve 62 has openings through the sidewall which can be aligned with the radial outlet passages 76. Various sizes, shapes and configurations of openings may be used to permit controlled amounts of cooling water to flow through the sleeve 62 when the sleeve is moved to different positions within the outlet plenum 72. The sizes, shapes and configuration of the openings may be altered about the circumference or along the axis of the sleeve for this purpose.

For example, openings may be configured in the sleeve 62 to permit the same or more water to flow through the center portion of the core 48 rather than in the end portions. As a result, independent control of the temperature between the center and the ends of the core 48 is provided.

Heat buildup in the center portion of the work roll 32 causes crowning to occur due to thermal expansion of the roll. In order to control this crowning, more cooling water is necessarily directed to the channels 68 near the center of the core 48. The increase in the cooling water flow at the center portion of the work roll 32 reduces the crown in relation to the increase in cooling water flow.

If it is desired to enlarge the crown on a roll 32, the cooling water directed to the center portion of the core 48 is reduced. This permits the center portion of the roll 32 to heat up relative to the ends of the roll. The result is thermal expansion of the core 48 and shell 46 in the center portion of the roll 32, creating the desired enlargement of the crown.

Figures 8A, 8B, 8C:
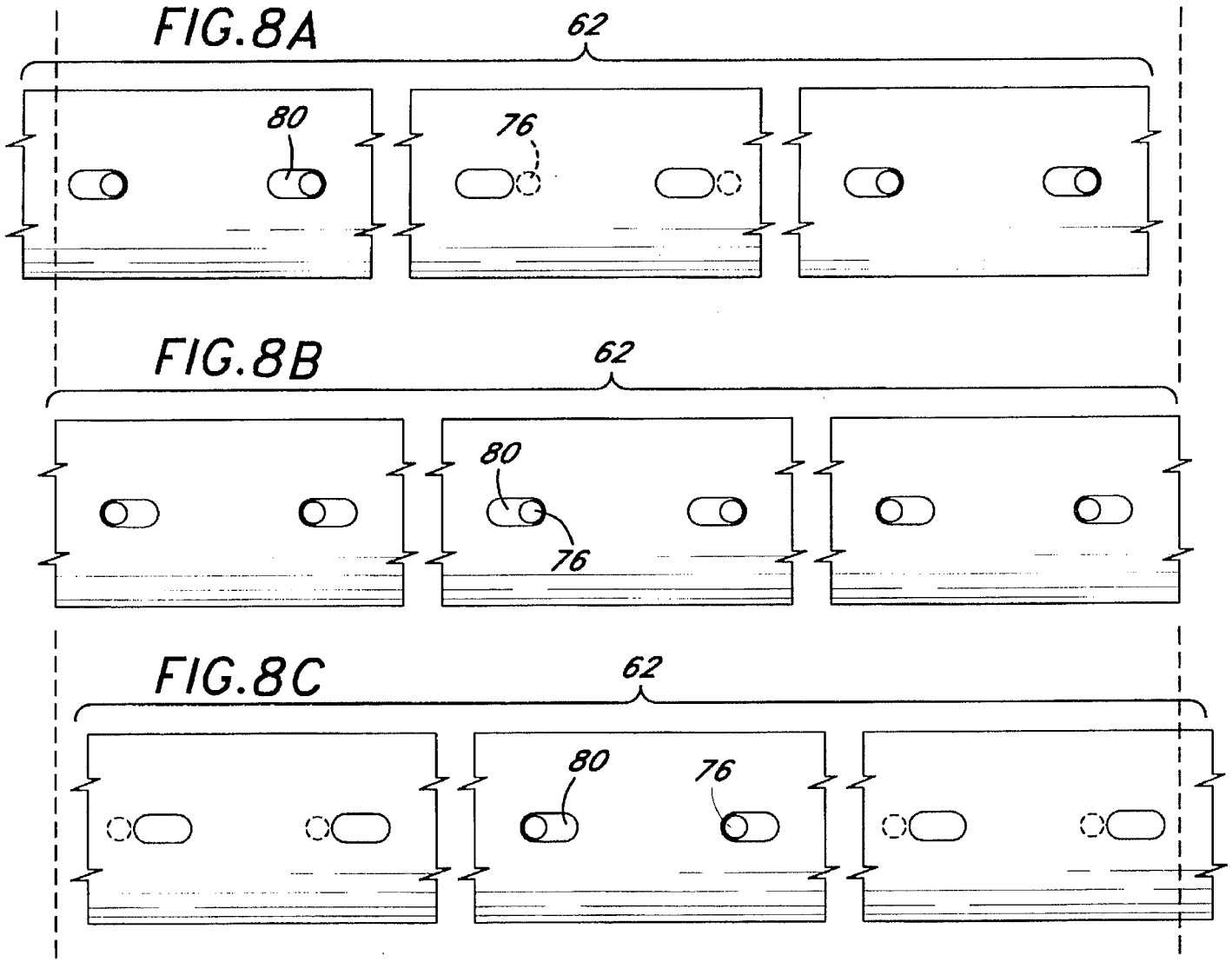
FIGS. 8*a*–8*c* are schematic representations of three positions of the sleeve shown in FIG. 7 relative to the central plenum whereby elongated slots in the sleeve are shown both in and out of alignment with radially extending cooling water passages in the core.

In the preferred form, the sleeve 62 is longitudinally divided into three general regions: a middle region and two outer regions. As shown in FIGS. 8*a–c*, the three regions each have a plurality of the elongated slots 80 which are positioned in a predetermined relationship to the outlet passages 76. With reference first to FIG. 8*b*, it is seen that the elongated slots 80 are designed to be aligned with all the outlet passages 76 to provide full cooling water flow through both the middle and outer regions of the core 48. In this position, the outlet passages 76 in the end regions of the sleeve 62 align with the left end of the elongated slots 80 in these regions. The outlet passages 76 in the middle region of the sleeve 62, however, are disposed to the right end of the elongated slots 80. Thus, when the sleeve 62 is displaced linearly to the left, as shown in FIG. 8*a*, the outlet passages 76 in the middle region are metered or restricted, while the outlet passages in the outer regions remain open and in communication with the interior of the sleeve 62 or outlet plenum 72. In the reverse situation, as shown in FIG. 8*c*, the sleeve 62 is displaced to the right, metering of the outlet passages 76 occurs in the outer regions, while full flow is maintained through the outlet passages in the middle region. It should be noted that in each of the regions shown in FIGS. 8*a–c*, the elongated slots 80 shown correspond to cooling subsystems which are spaced apart. As was described above, the outlet passages 76 connect with the outlet plenum 72 at offset locations in adjacent cooling subsystems which are spaced 60° around the outlet plenum. Thus, the views of FIGS. 8*a–c* do not show complete intermediate cooling subsystems and their associated slots 80 and outlet passages 76.

Figure 9:
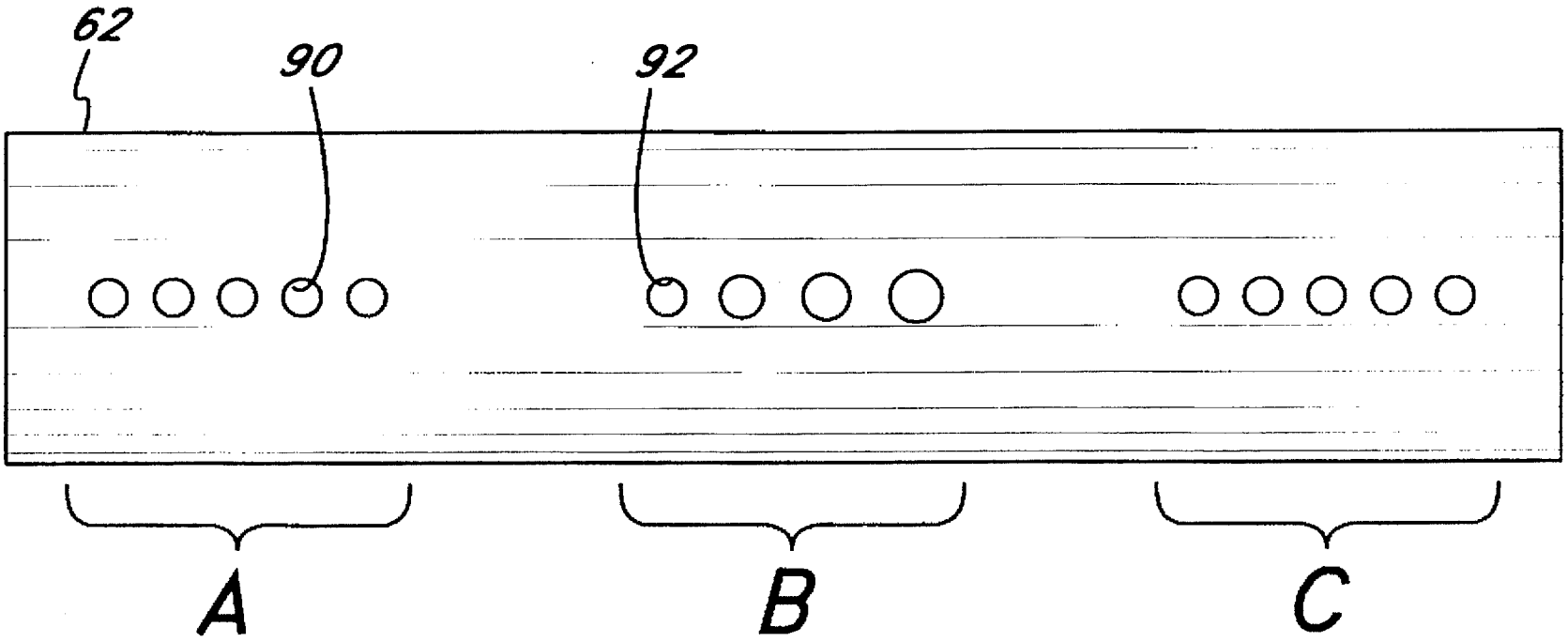
FIG. 9 is an alternative representation of a portion of the axially movable sleeve having water flow metering apertures.

In another embodiment of the invention, shown in FIG. 9, the sleeve 62 varies the water flow through only the center region of the core 48 when the sleeve is translated axially. Parallel or offset rows of circular holes 90, 92 are placed along the sleeve 62 alignable with the radial outlet passages 76. In the end portions of the sleeve 62, indicated by braces A and C, the holes 90 are all of the same size. The holes 92 in the center portion of the sleeve 62, indicated by brace B, decrease in size along the axis of the sleeve. As in the embodiment previously described, the sleeve is incrementally movable from a maximum flow position, where the largest of the holes 92 are aligned with the center outlet passages 76 to a minimum flow position, where the smallest of the center holes are aligned with the passages.

Figure 10A:
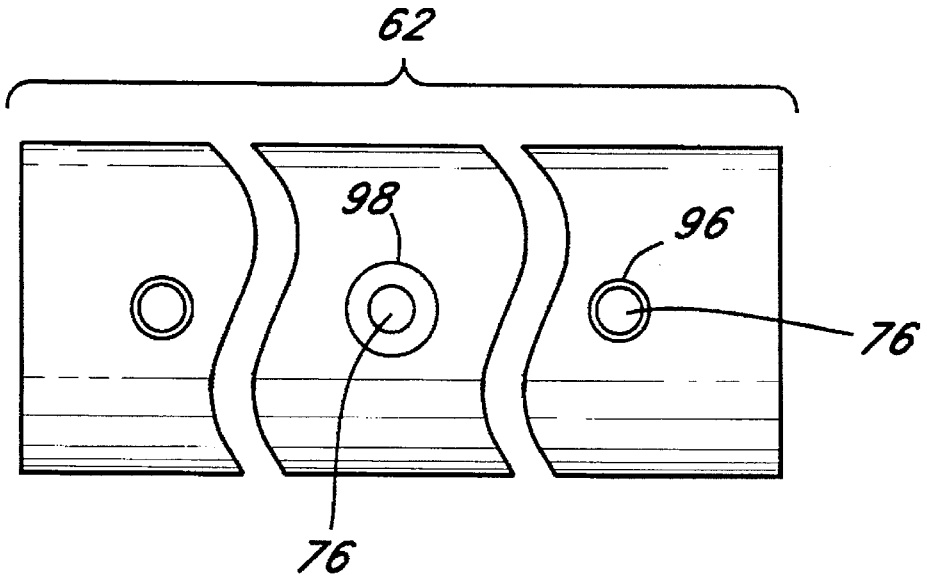
FIG. 10*a* is a second alternative embodiment of the axially movable sleeve having a different set of water metering apertures.

In another embodiment of the invention, shown in FIG. 10*a*, the sleeve 62 has only two sizes of openings 96 and 98 alignable with the outlet passages 76. The openings 98 in the portion of the core 48 where it is desirable to receive additional cooling water, typically the center, are circular holes which are relatively larger than the openings 96. The center holes 98 are larger than their associated outlet passages 76, while the remainder of the holes 96 are the same size as their associated outlet passages. As with the above-described embodiment, a mechanism is provided to move the sleeve 62 linearly to adjust to flow rate from a maximum flow position to a minimum flow position.

Figure 10B:
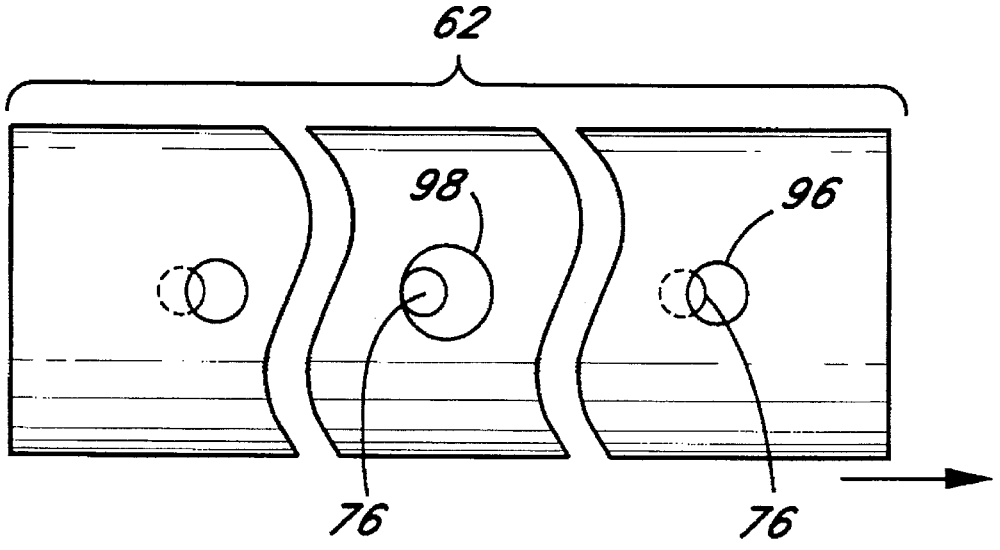
FIG. 10*b* is the sleeve of FIG. 10*a* axially displaced with respect to the water cooling passages of the core.

In the maximum flow position, all the openings 96 in each sleeve 62 are in alignment with the outlet passages 76. When, however, the sleeve is moved to a minimum flow position by translating the sleeve 62 along its axis, as shown in FIG. 10*b*, the larger openings 98, due to their large size, permit full water flow, while the remaining smaller openings 96 partially obstruct their associated outlet passages 76, permitting less water flow. The total flow of water through the cooling system may also be varied as the effective cross section of the smaller openings 96 is changed, permitting full control of the amount of cooling provided to the various portions of the core 62.

Figure 11A:
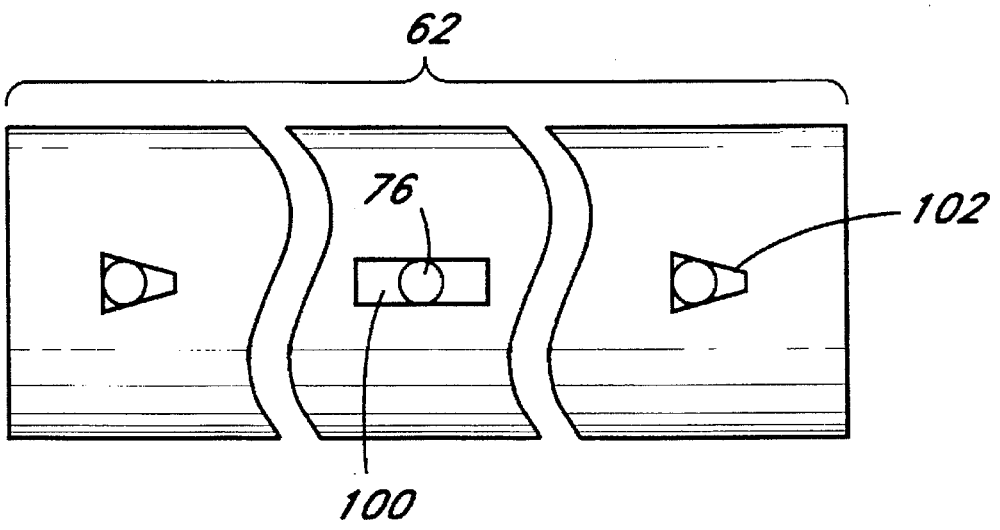
FIG. 11*a* is a still further alternative embodiment of the water metering apertures in the sleeve.
Figure 11B:
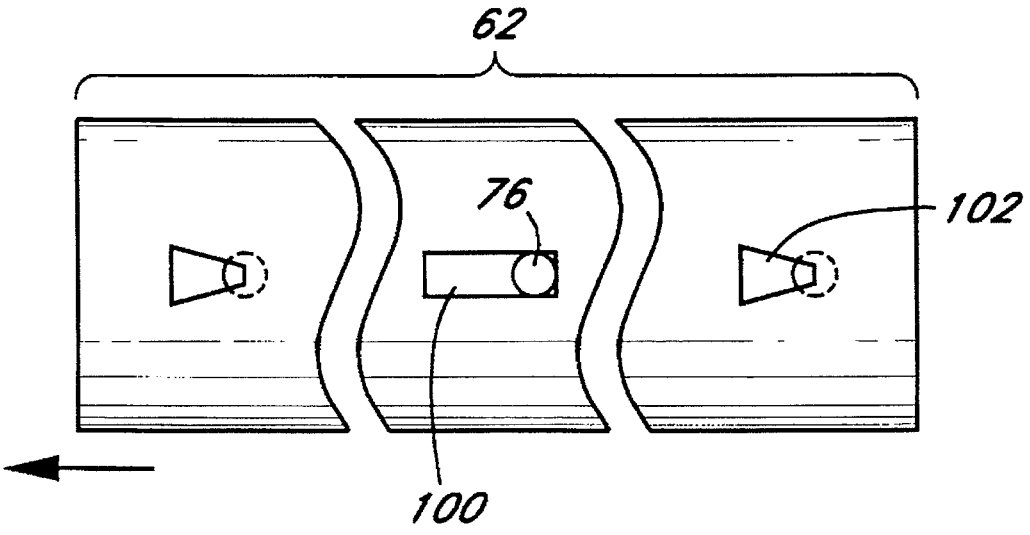
FIG. 11*b* is the sleeve of FIG. 11*a* axially displaced with respect to the water cooling passages of the core.

In another embodiment of the sleeve 62, shown in FIGS. 11*a* and 11*b*, differently shaped openings are used to control water flow to various portions of the core 48. The center openings 100 are shaped to permit a full flow of water at all settings of the sleeve 62 from the maximum to the minimum flow positions. A rectangle or other shaped hole may be used for these openings 100, which preferably has a long axis aligned in the direction of the axis of the sleeve 62. The widths of the openings 100 are preferably equal to or greater than their associated outlet passages 76 along the full length of their long axes.

The openings 102 in the outer ends of the sleeve 62 also preferably have a long axis aligned in the direction of the axis of the sleeve. However, the width of these openings 102 vary along the longitudinal axis. As in the previous embodiment, in different longitudinal positions of the sleeve 62, differing cross sections of the openings 102 are aligned (or not) with their associated outlet passages 76. To accomplish this, one end of the openings 102 is wider than the diameter of their associated outlet passages 76 while the other end of the openings is narrower. Translating the sleeve 62 axially causes maximum and minimum flow positions by changing the amount of water permitted to flow through these openings.

As illustrated, the openings 102 are shown linearly decreasing in size toward the right of the sleeve 62, but the change in size may be other than linear. For example, the openings 102 in the outer region of the sleeve 62 may be an hourglass shape so that as the sleeve is translated in one direction, the flow through the corresponding outlet passages 76 first decreases and then increases again to full flow. During this movement, the openings 100 in the middle portion may be gradually decreasing in size to meter the flow through the corresponding outlet passages 76. Of course, other arrangements are possible to obtain the preferred crown profile of the work roll 32.

In accordance with the above description of varying sleeve 62 configurations, the sleeves may also have a plurality of sets of slots 80 placed radially about the sleeve. Each set of slots 80 can be configured to provide a different water volume flow through various longitudinal portions of the core. The sleeve 62 is manually rotated to align a selected row of slots 80 with the radial outlet passages 76, thereby creating a particular flow pattern through the core.

Figure 7A:
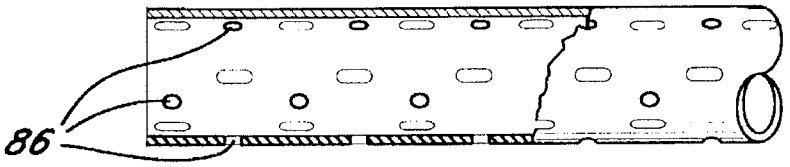
FIG. 7*a* is a partially cutaway side elevational view of an alternative sleeve embodiment.
Figure 7:
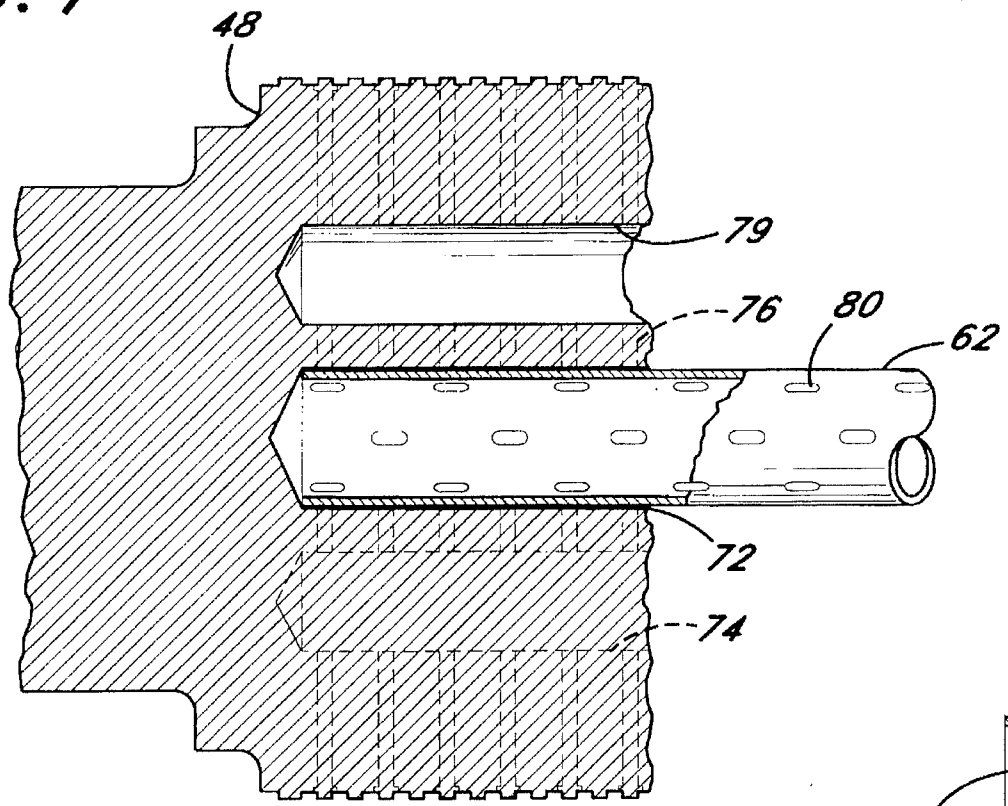
FIG. 7 is a partial transverse cross-sectional view through a work roll showing an axially movable sleeve in a central plenum.

Such an arrangement where the sleeve 62 has more than one set of slots 80 is shown in FIG. 7*a*. In this sleeve 62, a plurality of circular holes 86 are disposed around the periphery of the sleeve, in between the elongated slots 80. The holes 86 are oriented such that they will not come into alignment with any of the outlet passages 76 when the elongated slots 80 are being used. However, when the sleeve 62 is manually rotated with respect to the core 48, the holes 86 now determine the amount of flow metered through the outlet passages 76.

Figure 14:
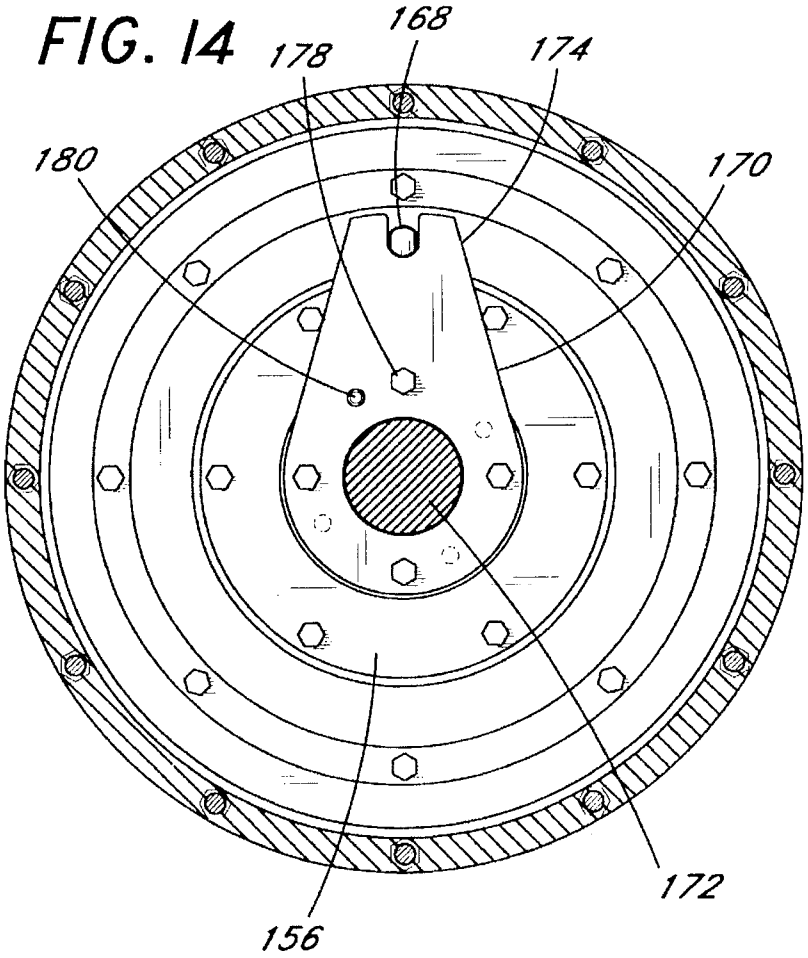
FIG. 14 is a cross-sectional view of a distal end of a rotating water joint taken along line 14—14 of FIG. 12.

The mechanism for allowing the manual rotation of the sleeve 62 will be described below in conjunction with FIGS. 12 and 14. As stated above, a particular sleeve 62 may contain slots 80 which permit a relatively larger water column flow through the middle and end portions of the core 48, while the two areas of the roll 32 between these portions receive a relatively smaller water flow. The heat buildup in the roll 32 resulting from this flow pattern creates a crown profile in the outer surface of the roll. Another sleeve may contain openings which permit a relatively larger water volume flow only at one end of the core 48 creating a roll 32 having a crown at one end. Other desired crown profiles may be created by utilizing other patterns of slots 80.

The slots 80 in each row are, in any case, configured to permit a change in water flow when the sleeve 62 is translated, as described in the previous embodiments. For example, all the slots 80 may be similarly tapered allowing the temperature of all portions of the roll 32 to be raised and lowered while maintaining the desired crown configuration. Thus, for example, the magnitude of the crown pattern mentioned above may be controlled by shifting the sleeve 62 longitudinally.

Water Flow Manager

Figure 12:
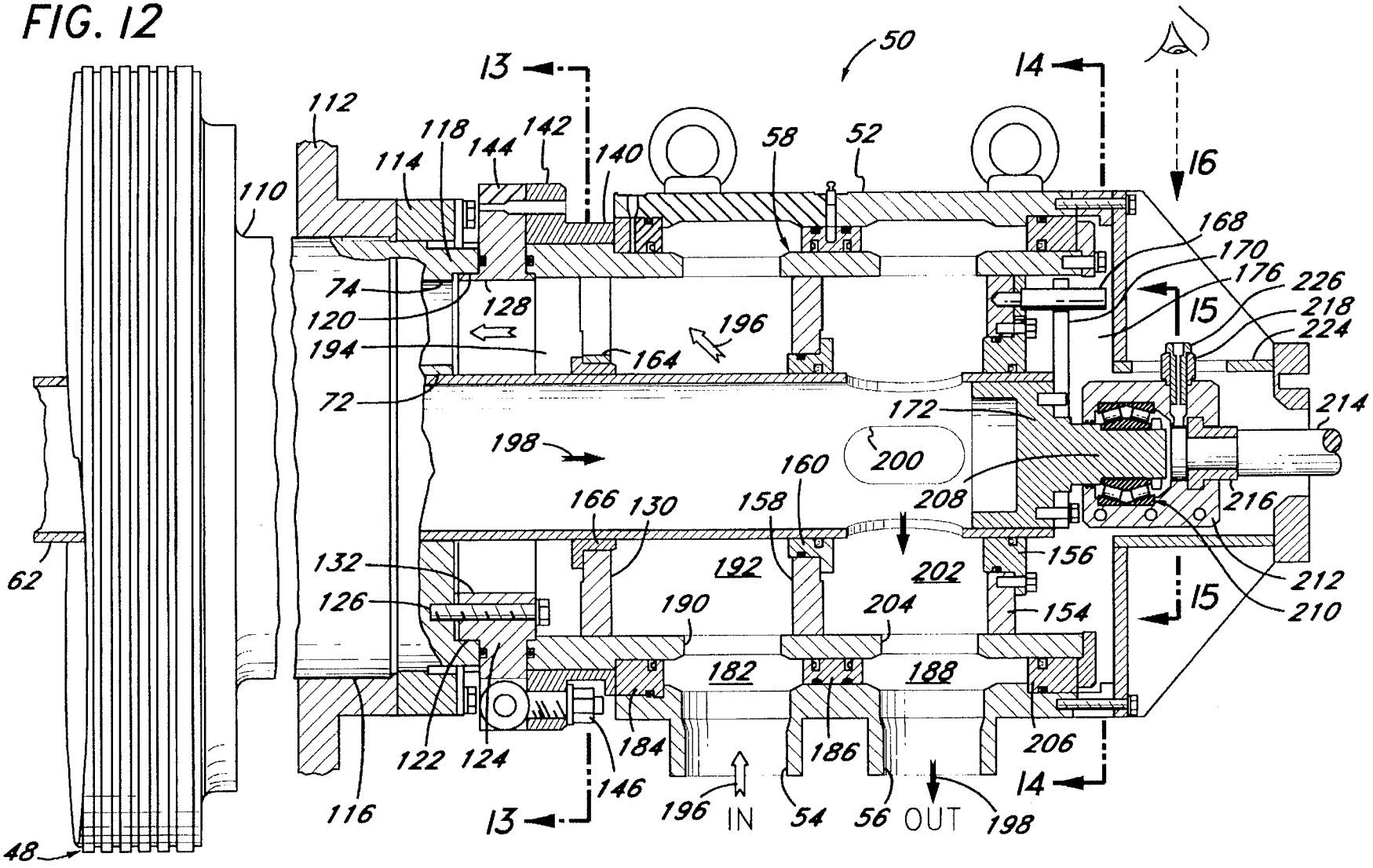
FIG. 12 is a cross-sectional view through a cooling water manager and sleeve actuating mechanism of the present invention.

Now referring to FIG. 12, a water flow control system or flow manager 50 is shown for use in conjunction with the sleeve 62 and plenums 72, 74. In general, the water flow manager 50 supplies and removes cooling water from the rotating core 48 utilizing a fluid-tight rotating water joint.

First, the construction of the terminal end of the core 48 will be explained. The core 48 includes a rounded shoulder 110 against which a retaining block (not shown) of a large bearing (see FIG. 2) abuts. A bearing mount 112, shown schematically in FIG. 12, contacts the large bearing in a compressive relationship due to a bolted-in bearing clamping ring 114. The outer race of the bearing is fixed with respect to the frame 34 of the casting machine 20.

The terminal end of the core 48 includes a reduced diameter portion 116 which extends out to an annular flange 118. The terminal end of the core 48 is recessed so that the inner surface of the annular flange 118 forms a concentric datum 120 which precisely locates a shoulder 122 of an adaptor plate 124. A number of long bolts 126 extend through the adaptor plate 124 and firmly fasten the solid end of the core 48 to the adaptor plate 124, as illustrated at the bottom portion of FIG. 12. The bolts 126 are located around the generally annular adaptor plate 124 and engage the core 48 in the solid region of the core 48 between the inlet plenums 74.

Figure 13:
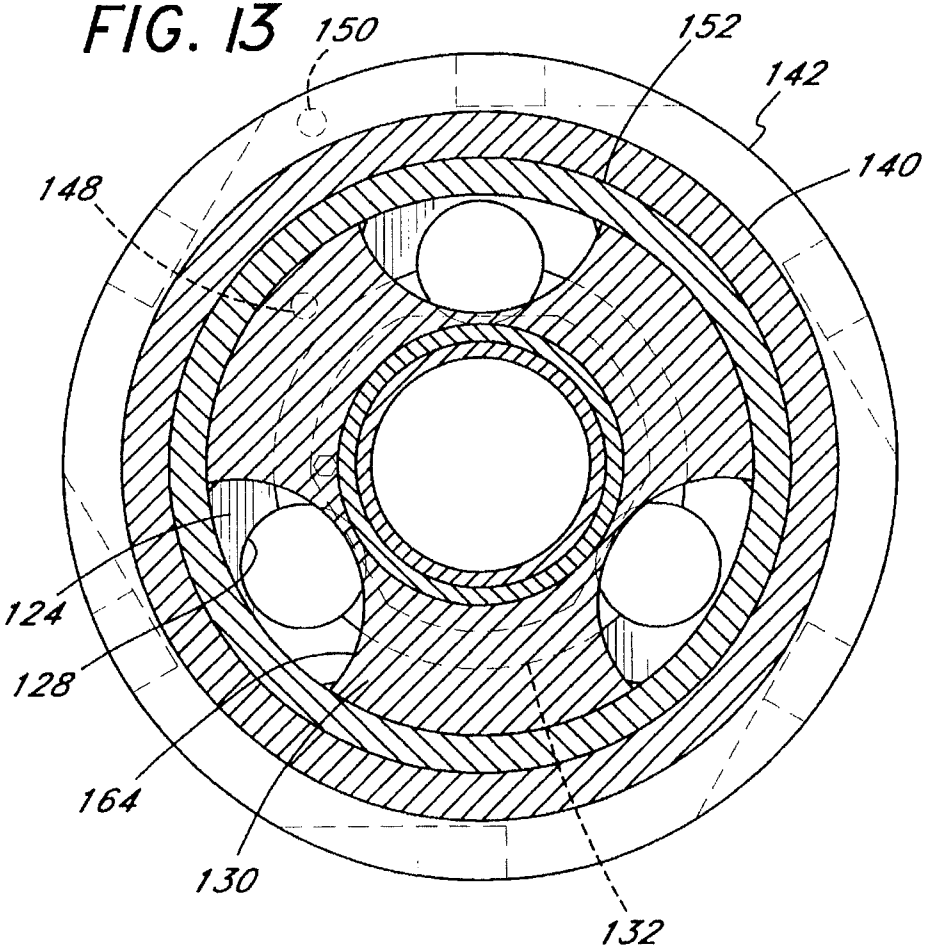
FIG. 13 is a cross-sectional view through the cooling water manager taken along line 13—13 of FIG. 12.

The adaptor plate 124 also comprises a number of cutouts which are generally aligned with each of the inlet plenums 74. As best seen in FIG. 13, the adaptor plate 124, which is partially obscured by a radial support wall 130, comprises a ring-shaped member having an inner edge 132 which is discontinuous at three locations where the generally semicircular cutouts 128 align with the three inlet plenums 74. Referring now again to FIG. 12, the inner edge 132 of the adaptor 124 has a larger diameter than the exterior of the sleeve 62 which extends into the outlet plenum 72 of the core 48.

A rotating generally cylindrical partition 58, is firmly bolted to the adaptor plate 124, and thus also rotates with the core 48. A mounting ring 140 is welded to the rotating partition 58 and has an outwardly extending mounting flange 142 which abuts an outwardly extending annular flange 144 of the adaptor plate to provide juxtaposed surfaces for large mounting bolts 146. Both the adaptor plate 124 and the rotating partition 58 are precisely aligned rotationally in a fixed orientation with respect to the core 48. As seen in FIG. 13, an orientation pin 148 extends through the adaptor plate 124 and into the end surface of the core 48. Likewise, an orientation pin 150 extends through the mounting flange 142 and into the annular flange 144. These orientations pins 148, 150 and their associated through holes are machined to tight tolerances so that the center lines of the bolt holes of the large elements are also precisely aligned.

The rotating partition 58 extends concentrically along the sleeve 62 and within an outer fixed water jacket 52. The rotating partition 58 comprises an outer housing 152 having a series of through holes, the housing divided into three annular regions surrounding the central sleeve 62 by three generally annular support walls 130, 154, 158 which extend between the inner surface of the housing 152 and the outer diameter of the sleeve 62. These walls are preferably welded to the inside of the housing 152 and have precision bushings mounted on their interior edge for contacting the sleeve 62 to allow for relative axial movement.

At the distal end of the rotating partition 58, an end wall 154 is welded to the housing 152 and has a first inner ring bushing 156 bolted thereto. Moving towards the core 48, a middle radial support wall 158 is also welded to the housing 152 and has a second inner ring bushing 160 firmly fixed thereto in an interference fit. Finally, the aforementioned radial support wall 130 having partial cutouts 164 therein is welded to the interior of the housing 152 at the proximal end and has a third inner ring bushing 166 affixed thereto, preferably in an interference fit, as well.

Although the sleeve 62 is journaled for axial movement within the bushings 156, 160 and 166, it is held in affixed rotational orientation with respect to the rotating partition 58 (which is, in turn, attached to rotating core 48) through the cooperation of a large orientation pin 168 and a sliding clevis-shaped bracket 170. Referring to FIG. 12 and FIG. 14, the bracket 170 is bolted to the exterior of an end plug 172 of the sleeve 62. The bracket 170 includes a bifurcated end 174 in which the orientation pin 168 is sized to fit. As the sleeve 62 translates axially, the bracket 170 slides over the pin 168 within a cavity 176, as seen in FIG. 12. The rigid attachment of the bracket 170 to the end plug 172 ensures the fixed rotation alignment of the sleeve 62 with respect to the rotating partition 58. Thus, the sleeve 62 rotates with the core 48 such that a given set of holes in the sleeve always are maintained in fixed relation to the passages 76, as was mentioned in relation to FIG. *7a*.

In a particularly advantageous feature of the present invention, the sleeve 62 may be reoriented with respect to the core 48 in order to align a different set of elongated slots 80 with the corresponding outlet passages 76. To accomplish this, the bolts 178 holding the bracket 170 to the exterior of the end plug 172 are removed so that the bracket may be reoriented with respect to the end plug. As seen in FIG. 14, a small orientation pin 180 extends into a through hole of the bracket 170, and thereafter into the end plug 172. The embodiment shown has four locations for the orientation pin 180 so that the bracket 170 can be reoriented at any one of four positions, which in this case are preferably spaced 90° apart. The orientation pin 180 and corresponding through holes in the bracket 170 and end plug 172 are precisely machined to prevent inadvertent vibratory motion in case one of the bolts 178 jars loose or fails. Once the bracket 170 has been repositioned and fastened on to the end plug 172, the entire sleeve 62 is rotated within the rotating partition 58 until the bifurcated end 174 again lines up with the large orientation pin 168. At this point, a new set of elongated holes 80 will be aligned with the outlet passages 76 to provide a different roll crown profile controlled by the linear position of the sleeve 62.

Water Flow

Inlet water from an outside source (not shown) enters the water manager 50 through the aforementioned inlet pipe 54. The water initially circulates through a first thin annular space 182 located between the external fixed water jacket 52 and the inner rotating partition 58. A first outer bushing 184 provides a seal between the partition 58 and jacket 52 to prevent inlet water from escaping to the exterior of the water manager 50. Additionally, a second outer bushing 186 prevents water from flowing to a second thin annular space 188. The inlet water passes through a plurality of partition inlets 190 in the housing 152 to enter an annular region 192 disposed between the housing and the sleeve 62. The inlet water is prevented from flowing towards the distal end of the water manager 50 by the middle support wall 158, and instead flows towards the work roll 32 through a plurality of the aforementioned partial cutouts 164 in the radial support wall 130. The cooling water continues to flow towards the core 48 into an annular region 194 which is between the radial support wall 130 and the adaptor plate 124. Water is allowed to circulate along the inner edge 132 of the adaptor plate 124 outside of the sleeve 62 and through the semicircular cutouts 128 which lead into the inlet plenums 74. Thus, it can be seen that inlet cooling water passes through the water manager 50 and into the core 48 to cool the work roll 32 prior to being discharged into the central outlet plenum 72 and into the interior of the sleeve 62. The inlet water flow within the water manager 50 is generally illustrated with arrows 196.

Now examining the water return, the outlet flow arrows 198 generally illustrate the path of the discharge water as it passes through the water manager S0. The discharge water travels the length of the sleeve 62 in the distal direction until reaching a plurality of oval sleeve outlets 200 which communicate with an annular region 202 between the sleeve and the housing 152 of the rotating partition. The hot outlet water then flows through a plurality of partition outlets 204 into the aforementioned second thin annular space 188 between the partition 58 and outer jacket 52. A third outer bushing 206 prevents water from escaping from between the partition 58 and jacket 52 at the distal end. The discharge water is then passed out through the outlet pipe 56.

It is apparent that as the partition 58 rotates with the core 48, the water flows into and out of the fixed outer jacket 52 and through the partition at the plurality of inlets 190 and outlets 204 which are preferably disposed around the entire cylindrical housing 152. The first, second, and third outer bushings 184, 186 and 206 provide a relatively frictionless journal mechanism for supporting the rotating partition 58 along its axis. In this respect, the outer jacket 52 is firmly affixed to the frame 34 or another rigid foundation (not shown). The outer bushings include both O-rings and seals to prevent water from escaping from the entire water manager 50 or from traveling between the various annular spaces in order to separate the cooling inlet water from the hot discharge water.

In a particularly important part of the present invention, the entire water manager 50 is held in a precisely concentric position relative to the centerline of the core 48. This is accomplished through the interaction of the distal end of the core 48, adaptor plate 124, mounting ring 140, and rotating partition 58. To be more specific, the adaptor plate 124 is rigidly held in a precise concentric position relative to the core 48. Subsequently, the mounting ring 140 is firmly bolted to the distal face of the adaptor plate 124 to hold the water manager 50 on the end of the work roll 32. The elements of the rotating partition 58 are machined to sufficient tolerances to ensure that the inner surfaces of the inner bushings 156, 160 and 166 are precisely oriented with respect to the concentric datum surface 120 of the reduced diameter portion 116 of the core. Thus, the surrounding supports for the sleeve 62 are all aligned along the axial direction to provide minimal resistance to axial displacement. In addition, runout is prevented. Therefore, the movement of the sleeve can be precisely controlled in order to provide crown control to an extremely fine degree.

Sleeve Displacement Actuator

The end plug 172 of the sleeve 62 includes a short stub shaft 208. The end of the stub shaft 208 is held within the inner race of a thrust bearing 210 which in turn is held within a split thrust bearing retainer 212. The weight of the sleeve 62 is primarily transmitted through the walls of the rotating partition 58 to the water jacket 52 such that the thrust bearing 210 need only provide a nominal amount of radial support to the stub shaft 208. The thrust bearing 210 is primarily designed to transmit axial forces from the linear actuator 60 shown in FIG. 2. In this respect, the actuator shaft 214 is firmly attached to a force couple member 216 which is also retained within the split thrust bearing retainer 212. Thus, displacement from the linear actuator 60 is transmitted through the shaft 214 and force couple 216 to the bearing retainer 212 and hence to the outer race of the thrust bearing 210. The thrust bearing transmits the applied forces to cause the sleeve 62 to move axially. The sleeve 62 is free to translate axially with respect to the inner bushings 156, 160 and 166 while rotating within these bearings with the core 48. Thus, linear displacement of the sleeve occurs in a relatively frictionless manner.

Figure 16:
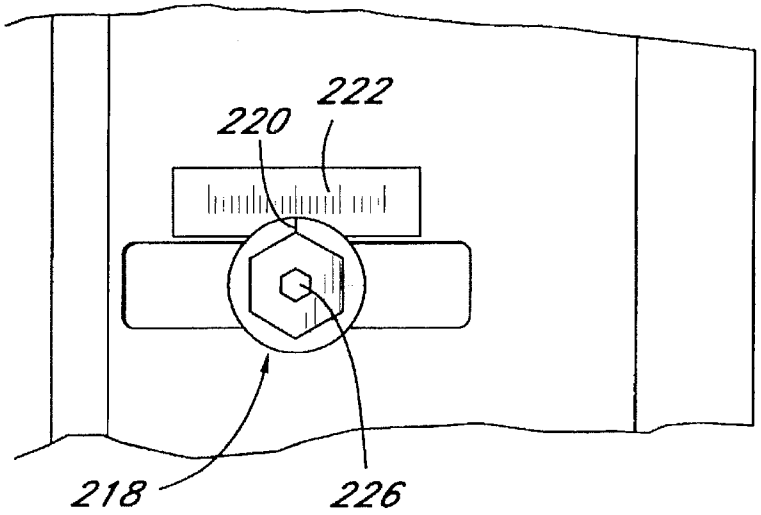
FIG. 16 is a detailed view of an axial position indicator taken along the line of sight 16—16 of FIG. 12.
Figure 15:
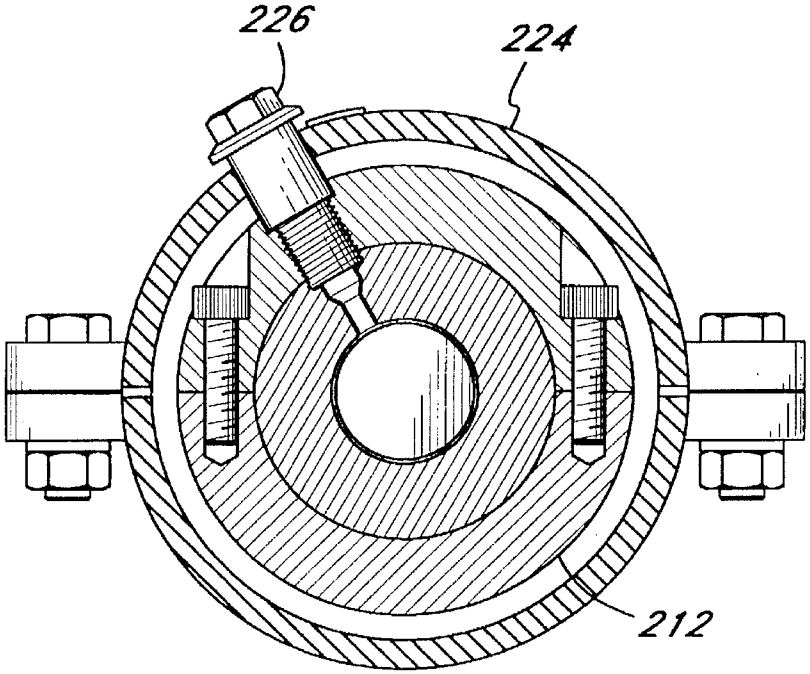
FIG. 15 is a cross-sectional view through a journal bearing retaining clamp taken along line 15—15 of FIG. 12.

The amount of axial sleeve 62 displacement is preferably measured by a sleeve position indicator 218, as best shown in FIGS. 15 and 16. The position indicator 218 includes a score mark 220 which aligns with marks of a scale affixed to a removable cover 224. The displacement of the sleeve position indicator 218 (and thus the sleeve 62) is thus measured on the scale 222. Preferably, the sleeve 62 indicator illustrates at least a 20-millimeter movement in either direction from a "zero" position. As seen in FIG. 15, the sleeve position indicator 218 also functions as a lubrication fitting 226 extending through the cover 224 and into communication with the cavity within the bearing retainer 212 in order to provide the proper lubrication to the thrust bearing 210.

The linear actuator 60 is preferably of an electrohydraulic type having an extremely fine displacement resolution. The actuator 60 is desirably a four-valve electrohydraulic type having a displacement resolution of 0.001 inch. A suitable actuator 60 is manufactured by Parker Fluidpower under the series number 2HX-LBT. Alternatively, the actuator may incorporate a servo valve for higher precision and better response time. However, this type of actuator is more expensive than the electrohydraulic type.

In view of the foregoing description of the invention, those skilled in the relevant arts will have no difficulties making changes and modifications in the different described elements of the invention in order to meet their specific requirements or conditions. For example, a four-inlet core may be utilized or more than four plenums may be used. Various other shapes may also be used in the same or other locations on the sleeve. Other types of valving may be used to differentially control the flow of water through the core.

Although this invention has been described in terms of certain preferred embodiments, other embodiments that are apparent to those of ordinary skill in the art are also within the range of this invention. Accordingly, the scope of the invention is intended to be defined only by reference to the following claims.

What is claimed is:

1. A roll casting machine including a pair of work rolls mounted in a frame for rotation about a centerline of said rolls, each roll including a shell mounted on a central core and a nozzle for introducing molten metal between said rolls, at least one of said rolls including a cooling system for controlling the shape of said roll, comprising:

at least two axially aligned inlet plenums located parallel to said centerline within said core for allowing cooling water to enter said roll;

a single outlet plenum located concentrically along the centerline of the core of said roll for allowing water to exit said roll;

a number of circumferential cooling channels formed between said shell and said core;

a number of substantially radial inlet passages connecting each inlet plenum to said channels on said core;

a number of radial outlet passages connecting said channels to said outlet plenum;

a sleeve located in said outlet plenum and connected to said roll for rotation therewith, said sleeve having a number of openings therein;

a water manager having a rotating portion attached to said roll and a fixed portion attached to the frame, said water manager including a thrust bearing journalled to an end of said sleeve, wherein said sleeve rotates with said roll and extends out one end of the roll;

a linear actuator attached to said fixed portion of said water manager, the linear actuator providing linear displacement to said sleeve through said thrust bearing for moving said sleeve between a first position where said openings in said sleeve are aligned with said radial outlet passages along the length of said roll, and a second position where said openings are aligned with said outlet passages only in particular areas along the length of said roll, whereby the shape of said roll is controlled by the variation in temperature along said roll caused by differentially metering the cooling water flow rate through various ones of said outlet passages with respect to other outlet passages along the roll, more cooling water flowing through a particular outlet passage resulting in more cooling and a smaller roll diameter at that axial location from thermal contraction of the core, and less cooling water resulting in less cooling and a larger roll diameter from thermal expansion of the core.

2. An apparatus for roll casting molten metal comprising:

a frame;

first and second work rolls rotatably mounted parallel and adjacent to each other in said frame, each roll including a shell mounted on a central core, said core being of solid construction over a majority of the cross-sectional area defined by the interior of said shell in order to withstand large compressive forces exerted on the exterior of the roll;

a fluid cooling system within at least one of raid rolls defined by at least two cooling subsystems spaced apart along the axial length of said roll, said subsystems comprising:

a cooling channel circumferentially disposed about said core;

three fluid inlet passages each in fluid communication with said channel, said fluid inlet passages terminating in apertures at the exterior of said core spaced 120° circumferentially from each other; and three fluid outlet passages each in fluid communication with said channel, said fluid outlet passages terminating in mouths at the exterior of the core spaced 120° circumferentially from each other end spaced from said inlet passage apertures by 60°;

three inlet plenums located in said core each of which is in fluid communication a different inlet passage;

an outlet plenum in said core located along a centerline of said roll in fluid communication with all three outlet passages; and a metering member positioned within said outlet plenum and adapted to vary the flow of cooling fluid through said outlet passages and control the flow rate of cooling fluid through said cooling subsystem.

3. The apparatus of claim 2, wherein said fluid cooling system within at least one of said rolls is defined by at least three cooling subsystems segmenting the work roll into three regions, a first of said regions being located in the middle of the work roll and second and third regions being located outside of said first region, and wherein said metering member may be displaced to vary the flow of cooling fluid through said first region while maintaining the flow rate of cooling fluid through said second and third regions constant.

4. The apparatus of claim 2, wherein said cooling channels are formed by spaced circumferential ribs along the length of the core and extend around the core in planes perpendicular to a central axis of the core.

5. The apparatus of claim 4, wherein said fluid inlet and said fluid outlet passages terminate in a common rib and fluidly communicate with two channels adjacent to said common rib.

6. The apparatus of claim 2, wherein said metering member is a hollow sleeve concentrically disposed within said outlet plenum and comprising a plurality of slots each in registration with a radially inner opening of an outlet passage, said sleeve being moveable with respect to said core to vary the amount of registration between slots and openings and vary the flow of cooling fluid into said outlet plenum from said outlet passages and associated cooling subsystems.

7. The apparatus of claim 6, wherein said hollow sleeve rotates with said roll and includes more than one set of slots for registering with said openings, only one set of slots being in registration with said openings when the sleeve is positioned with respect to said roll in one orientation, said apparatus further including an alignment mechanism adapted to rotationally fix said sleeve with respect to said roll, said alignment mechanism being dis-engageable allowing the rotation of said sleeve with respect to said roll in order to re-engage said alignment mechanism in a second orientation wherein a second set of slots are in registration with said openings.

8. The apparatus of claim 6, wherein said cooling fluid is water.

9. The apparatus of claim 8, wherein said hollow sleeve rotates with said roll and extends out one end of the roll into a water manager having a rotating portion attached to said roll and a fixed portion attached to said frame, said water manager including a linear actuator attached to said fixed portion and a thrust bearing journalled to an end of said sleeve, the linear actuator providing linear displacement to said sleeve through said thrust bearing to vary the registration of said slots with said openings.

10. The apparatus of claim 9, wherein said water manager further comprises:

a cooling water inlet pipe attached to said fixed portion in communication with a first region surrounding said sleeve, said first region being in fluid communication with said inlet plenums to define a cooling water flow path into said roll cooling system;

a cooling water outlet pipe attached to said fixed portion in communication with a second region surrounding said sleeve, said sleeve having discharge outlets within said second region allowing cooling water to exit said roll cooling system;

a barrier between said first region and said second region; and a seal between said rotating portion and said fixed portion.

11. An apparatus for controlling the flow rate of water through a rotating work roll of a roll caster, the work roll including at least one inlet cooling water passage and an outlet cooling water passage located along a centerline of the roll, comprising:

a fixed outer water jacket;

a rotatable partition located within said jacket and connected to said roll so as to rotate therewith; and an axially movable sleeve located partially within said outlet passage of said roll and located partially within said rotatable partition, said sleeve having apertures and being adapted to control the flow of cooling water to separate regions along the length of said roll upon axial displacement.

12. The apparatus of claim 11, wherein said apparatus further comprises:

a water inlet pipe attached to said water jacket in communication with a first region surrounding said sleeve, said first region being in fluid communication with said inlet passages to define a water flow path into said work roll;

a water outlet pipe attached to said water jacket in communication with a second region surrounding said sleeve, said sleeve having discharge outlets within said second region allowing water to exit said work roll;

a barrier between said first region and said second region; and a seal between said rotating partition and said water jacket.

13. The apparatus of claim 11, wherein said partition is mounted within said jacket on a number of first bushings which allow said partition to rotate with respect to said jacket, and wherein said sleeve is mounted within said partition on a number of second bushings which allow said sleeve to move axially with respect to said partition.

14. The apparatus of claim 13, wherein said apparatus includes at least one structural support wall extending between said partition and said sleeve, said second bushings being disposed between a radial inner rim of said wall and said sleeve.

15. The apparatus of claim 13, wherein said number of second bushings are precisely located concentrically along said work roll axis to facilitate axial displacement of said sleeve.

16. An apparatus for controlling the flow rate of fluid through a rotating work roll of a roll caster, the work roll mounted to rotate on a rigid support and including at least one inlet cooling fluid plenum and an outlet cooling fluid plenum heated along a centerline of the roll, the roll having passages formed therein spaced along its axial length for circulating cooling fluid to a peripheral region, each passage terminating at a radially inner opening at the intersection with the outlet cooling plenum, comprising:

a fixed outer jacket mounted on a frame at one end of the roll, the frame being in a fixed relationship with respect to the roll support;

a fluid inlet pipe attached to the jacket;

a fluid outlet pipe attached to the jacket;

a rotatable partition concentrically located within the jacket and connected to the roll so as to rotate therewith along the roll axis; and a sleeve located partially within the outlet plenum of the roll and located partially within the rotatable partition, the sleeve having apertures in registry with the openings and being adapted to control the flow of cooling fluid to separate regions along the length of the roll upon displacement in a first movement direction with respect to the partition.

17. The apparatus of claim 16, further comprising:

a first region surrounding the sleeve and within the partition in fluid communication with the inlet pipe, the first region being in fluid communication with the inlet plenum to define a fluid flow path into the work roll;

a second region surrounding the sleeve and within the partition in fluid communication with the outlet pipe, the sleeve having discharge outlets opening into the second region allowing fluid to exit the work roll;

a barrier between the first region and the second region; and a seal between the rotating partition and the jacket.

18. The apparatus of claim 16, wherein the partition is mounted within the jacket on a number of first bushings provided between the jacket and the partition which allow the partition to rotate with respect to the jacket, and wherein the sleeve is mounted on a number of second bushings provided between the partition and the sleeve which allow the sleeve to be displaced with respect to the partition.

19. The apparatus of claim 18, wherein the apparatus includes at least one structural support wall extending between the partition and the sleeve, the second bushings being disposed between a radial inner rim of the wall and the sleeve.

20. The apparatus of claim 18, wherein the second bushings comprise linear bushings allowing the sleeve to be displaced axially with respect to the partition.

21. The apparatus of claim 18, wherein the number of second bushings are located concentrically along the work roll axis to facilitate axial displacement of the sleeve.

22. The apparatus of claim 21, wherein the partition is fixed with respect to a datum surface defined on the end of the work roll and the second bushings are located concentrically with respect to the datum surface to define an axis common to the roll axis along which the sleeve may be axially displaced within the second bushings with a minimum of resistance.

23. The apparatus of claim 22, further including an adapter plate mounted between the roll and the partition, the adapter plate being bolted to the datum surface and the partition being rigidly attached to the adapter plate.

24. The apparatus of claim 23, further including a rotational orientation pin sized to fit within juxtaposed apertures in both the adapter plate and the roll to ensure accurate rotational alignment between the adapter plate and the roll.

25. The apparatus of claim 24, further including a rotational orientation pin sized to fit within juxtaposed apertures in both the adapter plate and the partition to ensure accurate rotational alignment between the adapter plate and the partition.

26. The apparatus of claim 16, further comprising:

cooperating means on both the sleeve and partition for preventing displacement of the sleeve with respect to the partition in a second movement direction, the cooperating means allowing sleeve displacement with respect to the partition in the first movement direction.

27. The apparatus of claim 26, wherein the first movement direction is translation along the roll axis and the second movement direction is rotation about the roll axis.

28. The apparatus of claim 26, wherein some of the sleeve apertures are in registration with the cooling passage inner openings such that sleeve displacement with respect to the roll varies the amount of registration between the apertures and openings to vary the flow of cooling fluid into the outlet plenum, and wherein the sleeve includes more than one set of apertures for registering with the openings, only one set of apertures being in registration with the openings when the sleeve is positioned with respect to the roll in one orientation, the cooperating means being adjustable to rotationally reorient the sleeve and partition so as to register a second set of apertures with the openings.

29. The apparatus of claim 16, wherein the sleeve is connected to the partition so as to rotate therewith about the roll axis.

30. The apparatus of claim 22, further comprising:

an orientation pin axially extending from the rotating partition at a radial distance from the sleeve axis;

a bracket attached to the sleeve and extending outward therefrom to mate in a sliding fit with the orientation pin so as to allow relative axial displacement of the bracket with respect to the orientation pin while restricting relative rotational displacement.

31. The apparatus of claim 30, wherein the bracket is adjustably attached to the sleeve so as to enable detachment and relative rotation therebetween.

32. The apparatus of claim 31, wherein the bracket is bolted to a plug of the sleeve on an end away from the roll, the bracket and plug including a plurality of evenly circumferentially spaced bolt holes to enable the detachment and relative rotation.

33. The apparatus of claim 32, further including a first orientation hole formed in one of the bracket and the plug and a plurality of second orientation holes equal in number to the plurality of evenly circumferentially spaced bolt holes in the other of the bracket and the plug, and a second orientation pin sized to fit into the first orientation hole and into one of the plurality of second orientation holes to align the plurality of evenly circumferentially spaced bolt holes in the bracket and the plug in various relative rotational orientations.

34. The apparatus of claim 16, wherein the rotatable partition comprises:

a generally cylindrical outer housing journalled for rotation within the jacket;

a first annular support wall having an inner edge journalled about the sleeve and an outer edge fixedly attached to the outer housing;

a second annular support wall having an inner edge journalled about the sleeve and an outer edge fixedly attached to the outer housing, the second annular support wall being spaced from the first annular support wall toward the roll creating a first annular region surrounding the sleeve and within the housing in communication with the interior of the sleeve; and a third annular support wall having an inner edge journalled about the sleeve and an outer edge fixedly attached to the outer housing, the third annular support wall being spaced from the second annuls support wall toward the roll creating a second annular region surrounding the sleeve and within the housing in communication with all of the inlet cooling fluid plenum.

35. The apparatus of claim 34, further comprising:

discharge outlets in the sleeve opening into the first region;

outlets in the housing providing fluid communication between the first region and the fluid outlet pipe to allow fluid to the exit the work roll; and inlets formed in the housing providing fluid communication between the fluid inlet pipe and the second region to allow fluid to the enter the work roll.

36. The apparatus of claim 35, further comprising a plurality of sealed bushings provided between the outer housing and the jacket allowing relative rotation therebetween and preventing fluid flow between first and second annular cavities formed between the outer housing and the jacket adjacent the fluid inlet and outlet pipes, respectively, and preventing fluid from escaping from the first and second annular cavities to the exterior of the jacket.

37. The apparatus of claim 34, wherein the first and second annular walls are solid, and the third annular wall includes a peripheral cutout allowing cooling fluid to pass between the second region and the inlet cooling fluid plenum.

38. The apparatus of claim 34, wherein the first, second and third annular walls are separately formed and attached at their outer edges to the inner surface of the housing.

39. The apparatus of claim 16, wherein the sleeve has a closed end extending away from the roll having a shaft extending therefrom, and the apparatus further comprises:

a thrust bearing supported by the jacket and journalled over the shaft to allow relative rotation and enable axial force to be transmitted between the bearing and shaft; and a linear actuator coupled to the thrust bearing for displacing the sleeve.

40. The apparatus of claim 39, wherein the linear actuator has a displacement resolution of about 0.001 inch.

41. The apparatus of claim 39, wherein the linear actuator is a four-valve electrohydraulic type.

42. The apparatus of claim 41, wherein the linear actuator incorporates a servo valve for higher precision.

43. The apparatus of claim 39, wherein the thrust bearing is mounted within a retainer having a position indicator attached thereto and visible on the exterior of the jacket, the jacket including a scale which, in combination with the position indicator, displays the linear position of the sleeve with respect to the jacket.

44. The apparatus of claim 43, wherein the position indicator is a hollow shaft and provides a channel for lubricating the thrust bearing.

45. A method of circulating cooling fluid to and from peripheral cooling channels of a roll of a roll caster, the roll having passages formed therein spaced along its axial length for circulating cooling fluid to said peripheral channels, each passage terminating at a radially inner opening at the intersection with a central fluid outlet cooling plenum formed in the roll, the roll further including at least one axially extending fluid inlet cooling plenum offset from the roll axis, the method comprising the steps of:

supplying inlet cooling fluid to a first port of a fixed jacket mounted on a frame at one end of the roll, the frame being in a fixed relationship with respect to a rigid roll support;

extracting outlet cooling fluid from a second port of the jacket;

rotating a partition with the roll and along the roll axis, the partition being concentrically located within the jacket; and displacing a sleeve in a first movement direction with respect to the partition, the sleeve located partially within the outlet plenum of the roll and partially within the rotatable partition, the sleeve having apertures and being adapted to control the flow of cooling fluid from the cooling passage openings along the length of the roll upon said displacement.

46. The method of claim 45, further including the steps of:

rotating the partition within the jacket on a number of first bushings provided between the jacket and partition; and displacing the sleeve in an axial direction with respect to the partition along a number of second bushings provided between the partition and sleeve.

47. The method of claim 46, further including the step of:

locating the second bushings concentrically along the work roll axis to facilitate axial displacement of the sleeve.

48. The method of claim 45, further including the step of:

preventing displacement of the sleeve with respect to the partition in a second movement direction with cooperating means on both the sleeve and partition which allows sleeve displacement with respect to the partition in the first movement direction.

49. The method of claim 48, wherein the step of preventing comprises preventing rotation of the sleeve about the roll axis with respect to the partition with the cooperating means which allows translation along the roll axis with respect to the partition.

50. The method of claim 45, further including the steps of:

registering some of the sleeve apertures with the cooling passage inner openings;

varying the amount of registration between the apertures and openings to vary the flow of cooling fluid into the outlet plenum by the step of sleeve displacement with respect to the partition, and wherein the sleeve includes more than one set of apertures for registering with the openings, only one set of apertures being in registration with the openings when the sleeve is positioned with respect to the roll in one orientation; and registering a second set of apertures with the openings by adjusting the cooperating means to rotationally reorient the sleeve and partition.

51. The method of claim 45, further including the step of:

connecting rite sleeve to the partition so as to rotate therewith about the roll axis.

52. The method of claim 51, further including the step of:

mating a radially extending portion of a bracket attached to the sleeve in a sliding fit with an orientation pin axially extending from the rotating partition at a radial distance from the sleeve axis so as to allow relative axial displacement of the partition with respect to the sleeve while restricting relative rotational displacement therebetween.

53. The method of claim 52, further including the step of:

detaching, rotating and reattaching the bracket with respect to the sleeve to adjust the rotational orientation of the partition with respect to the sleeve.

54. The method of claim 45, further including the steps of:

rotatably supporting a shaft extending from a closed end of the sleeve with a thrust bearing mounted in the jacket to enable axial force to be transmitted between the bearing and shaft; and said step of displacing comprises displacing the sleeve with a linear actuator coupled to the thrust bearing.

55. The method of claim 54, further including the step of:

displacing the sleeve with the linear actuator in increments of about 0.001 inch.

56. The method of claim 54, further including the step of:

displaying the linear position of the sleeve with respect to the jacket with a position indicator against a linear scale on the jacket, the position indicator being attached to a retainer within which the thrust bearing is mounted so as to be displaced with the bearing.

57. The method of claim 56, further including the step of:

lubricating the thrust bearing through a channel formed by the position indicator.

* * * * *